US006661443B2

(12) United States Patent
Bybell et al.

(10) Patent No.: US 6,661,443 B2
(45) Date of Patent: Dec. 9, 2003

(54) METHOD AND APPARATUS FOR VOLTAGE CORRECTION

(75) Inventors: Daniel P. Bybell, Medford, MA (US); Jay E. Thornton, Watertown, MA (US)

(73) Assignee: Polaroid Corporation, Waltham, MA (US)

( * ) Notice: Subject to any disclaimer, the term of this patent is extended or adjusted under 35 U.S.C. 154(b) by 0 days.

(21) Appl. No.: 10/147,198

(22) Filed: May 16, 2002

(65) Prior Publication Data

US 2003/0160858 A1 Aug. 28, 2003

Related U.S. Application Data

(60) Provisional application No. 60/358,977, filed on Feb. 22, 2002.

(51) Int. Cl.[7] ..... B41J 2/36
(52) U.S. Cl. ..... 347/190
(58) Field of Search ..... 347/188, 190; 400/120.1

(56) References Cited

U.S. PATENT DOCUMENTS

| | | | | |
|---|---|---|---|---|
| 4,524,368 A | 6/1985 | Inui et al. | ..... | 346/76 PH |
| 4,563,691 A | 1/1986 | Noguchi et al. | ..... | 346/76 |
| 5,109,235 A | 4/1992 | Sasaki | ..... | 346/76 PH |
| 5,469,203 A | 11/1995 | Hauschild | ..... | 347/190 |
| 5,497,174 A | 3/1996 | Stephany et al. | ..... | 347/13 |
| 5,625,399 A | 4/1997 | Wiklof et al. | ..... | 347/195 |
| 5,784,092 A | 7/1998 | Fukuoka | ..... | 347/190 |
| 5,786,837 A | 7/1998 | Kaerts et al. | ..... | 347/190 |

FOREIGN PATENT DOCUMENTS

| | | | |
|---|---|---|---|
| EP | 0 625 425 A2 | 11/1994 | ..... B41J/2/36 |
| EP | 1 004 442 A2 | 5/2000 | ..... B41J/2/05 |
| EP | 1 078 750 A2 | 2/2001 | ..... B41J/2/05 |

*Primary Examiner*—Huan H. Tran

(57) ABSTRACT

A method is provided for providing the same amount of energy to each print head element in a thermal printer during each print head cycle used to print an image, regardless of the number of print head elements that are active during each print head cycle. The desired amount of energy may be provided to a plurality of print head elements that are active during a print head cycle by delivering power to the plurality of print head elements for a period of time whose duration is based in part on the number of active print head elements. The period of time may be a portion of the print head cycle.

15 Claims, 12 Drawing Sheets

METHOD AND APPARATUS FOR VOLTAGE CORRECTION

CROSS-REFERENCE TO RELATED APPLICATIONS

This application claims the benefit of prior provisional patent application Ser. No. 60/358,977, filed Feb. 22, 2002.

BACKGROUND

1. Field of the Invention

The present invention relates to controlling delivery of power to electronic circuitry and, more particularly, to controlling delivery of power to thermal print head elements to improve print output quality.

2. Related Art

Thermal printers typically contain a linear array of heating elements (also referred to herein as "print head elements") that print pixels on an output medium by transferring pigment from a donor sheet to the output medium (such as plain paper). Each of the print head elements, when activated, transfers pigment to a region of the output medium passing underneath the print head element, creating what is referred to herein as a "spot." Digital images are rendered as two-dimensional arrays of very small and closely-spaced spots.

Different numbers and combinations of print head elements may be active at different times when printing a digital image, depending on the intensities of the pixels in the digital image. As a result of the circuitry that is typically used to provide power to the print head elements in a thermal printer, spots that are printed by a large number of contemporaneously active print head elements appear lighter than spots that are printed by a small number of contemporaneously active print head elements. This difference in rendered intensity is undesirable because it corresponds to the number of contemporaneously active print head elements, rather than to the intensities of the pixels in the source image being printed. The result is a printed image having undesired variations in intensity that do not accurately reflect the intensities of the pixels in the source image being printed.

One attempt to solve this problem has been to increase the gray levels of pixels in a particular row of a grayscale digital image being printed as the aggregate gray level of the pixels in the row increases. For example, if the aggregate gray level of the pixels in a row is large, the gray level of each pixel may be increased in an attempt to compensate for the effective decrease in gray level described above. The gray level of a pixel is typically increased by activating the corresponding print head element for a greater number of print head cycles, thereby printing a greater number of spots than would normally be used to print the pixel. Although this technique may result in some improvement in output image quality, it may fail to work properly in conjunction with certain conventional techniques used in thermal printing, as described in more detail below.

What is needed, therefore, are improved techniques for accurately printing different tones (e.g., gray levels) using a thermal printer, regardless of the number of print head elements that are contemporaneously active at any particular point in time.

SUMMARY

In one aspect of the present invention, a method is provided for providing the same amount of energy to each print head element in a thermal printer during each print head cycle used to print an image, regardless of the number of print head elements that are active during each print head cycle. In one embodiment, the desired amount of energy is provided to a plurality of print head elements that are active during a print head cycle by delivering power to the plurality of print head elements for a period of time whose duration is based in part on the number of active print head elements. The period of time may be a portion of the print head cycle. For example, the number of print head elements that are to be active during a particular print head cycle may be determined (e.g., at or slightly before the beginning of the print head cycle), and power may be delivered to the active print head elements for an amount of time during the print head cycle based on the number of active print head elements. The amount of time may be chosen so that the total amount of energy delivered by each active print head element to an output medium during each print head cycle remains constant from print head cycle to print head cycle, regardless of the number of active print head elements in any particular print head cycle.

A correction factor may be used in the process of selecting the amount of time to activate print head elements during a particular print head cycle. In one aspect of the present invention, a parameter of the correction factor (or an approximation thereto) may be developed using a source target rendered on an output medium as an output target. The output target may be visually inspected and the value of the parameter may be derived from observations made during the visual inspection. For example, as described in more detail below, the source target may contain a first and second plurality of source regions having the same intensity (e.g., gray level). Pixels in the first plurality of source regions are arranged so that a first predetermined number of heating elements are active when the first plurality of source regions are rendered on the output medium as a first plurality of output regions. The first plurality of source regions are rendered on the output medium using a constant duty cycle. Pixels in the second plurality of source regions are arranged so that a second predetermined number of heating elements are active when the second plurality of source regions are rendered on the output medium as a second plurality of output regions. The second plurality of source regions are rendered on the output medium using a plurality of duty cycles (e.g., as described below with respect to steps 708 and 728). The second plurality of output regions therefore have a variety of blacknesses.

The output target may be visually inspected to identify one of the second plurality of output regions whose blackness most closely matches the blackness of the first plurality of output regions. The second plurality of output regions may be located near the first plurality of output regions to facilitate such identification. The parameter of the correction factor may be determined based on the selected one of the second plurality of output regions, as described in more detail below.

Additional aspects and embodiments of the present invention will be described in more detail below.

DETAILED DESCRIPTION

Figure 1A:
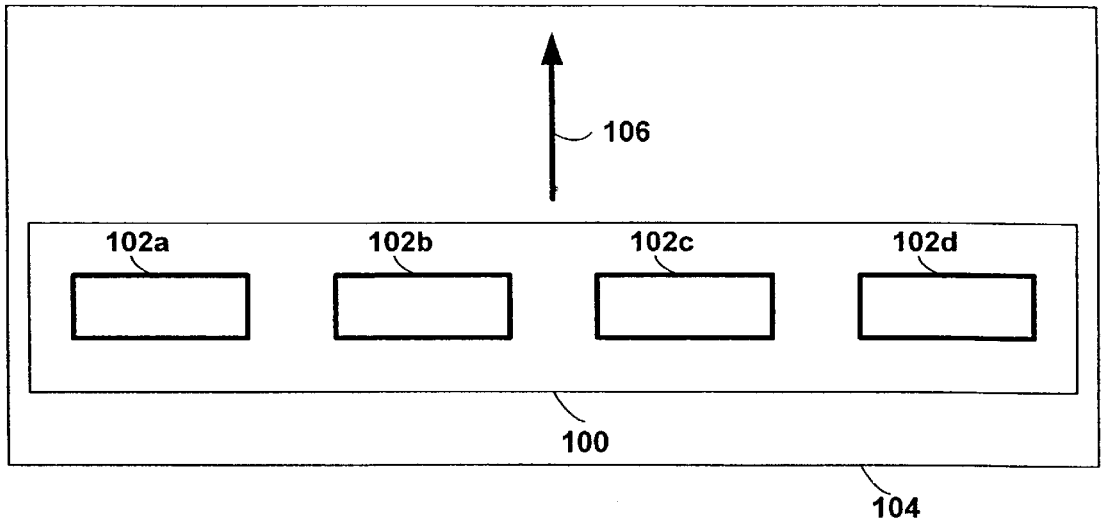
FIG. 1A (PRIOR ART)
FIG. 1A is a block diagram of a conventional thermal-transfer print head and an output medium on which the print head is capable of printing.

Before describing various embodiments of the present invention, certain terms will be defined.

Pulse or Heating Pulse. A small period of time during which a heating element of a thermal print head is energized or ON. Electrical current flows through the resistive element of the head causing it to heat. The time period for which the pulse is ON is often referred to as the "pulse width."

Pixel. An abbreviation for "picture element," a pixel is the smallest spatial unit of a digital image. A digital image is composed of a collection of pixels typically arranged in a rectangular array. Each pixel has a location, typically expressed in terms of x (column) and y (row) coordinates, and a digital value, which may represent any tone such as a color or a shade of gray. Pixels typically adjoin each other when rendered on various output media, although they may overlap or be spaced apart to various degrees when rendered. Various well-known techniques have been developed for representing the locations and tones of pixels.

Spot. A "physical spot," as used herein, is a small shape, such as a rectangle or disk, that an output device has rendered at a particular point or within a particular area on an output medium. A physical spot is the smallest unit of output that an output device can generate. For example, a physical spot may be a spot of ink printed by a printer or a pixel displayed by a monitor. A physical spot may be any shape, such as a rectangle, rounded rectangle, or circle. Different output devices may render physical spots of different shapes and sizes, and a single output device may be capable of printing physical spots of varying sizes. For example, thermal-transfer printers typically pulse their heating elements to create physical spots. Each pulse of a heating element transfers a small amount of wax or ink to the output medium creating a small physical spot. A single heating element may be pulsed many times in succession to create many physical spots that together form a larger physical spot.

A "logical spot," as used herein, is a digital representation of a physical spot. A logical spot may be represented as, for example, a single bit in a bitmap. A logical spot may be stored in, for example, a computer-readable memory such as a RAM or in a file on a disk. As used herein, the term "spot" refers to both physical spots and to logical spots.

Render. As used herein, the term "rendering" refers to the process of producing output on an output medium using an output device. For example, "rendering" includes printing ink or toner on a printed page, displaying pixels on a computer monitor, and storing a bitmap in RAM or other storage.

Region. As used herein, a "region" of an image may refer to any area within the image. For example, a region in a digital source image may include an area containing a single pixel or a collection of pixels, such as a two-dimensional array of pixels.

Print Head Cycle (or Cycle). As used herein, a "print head cycle" is the time allotted for one pulse of the heating elements. A cycle usually starts with the beginning of a heating pulse. The length of a cycle must be at least as long as the heating pulse and is usually longer, with the heating pulse in the latter case occupying some fraction of the print head cycle.

Duty Cycle. As used herein, "duty cycle" refers to the fraction of a print head cycle occupied by a heating pulse. The term "duty cycle" is typically used in the context of repeating print head cycles occurring at fixed time intervals with all heating pulses occupying the identical fractions of their respective print head cycles. It is given as the ratio of the heating pulse time to the head cycle time. For example, if a heating pulse occurs for ¾ of the duration of a print head cycle, then the duty cycle may be expressed as 0.75 or 75%.

In one aspect of the present invention, a method is provided for providing the same amount of energy to each print head element in a thermal printer during each print head cycle used to print an image, regardless of the number of print head elements that are active during each print head cycle. In one embodiment, the desired amount of energy is provided to a plurality of print head elements that are active during a print head cycle by delivering power to the plurality of print head elements for a period of time whose duration is based in part on the number of active print head elements. The period of time may be a portion of the print head cycle. For example, the number of print head elements that are to be active during a particular print head cycle may be determined (e.g., at or slightly before the beginning of the print head cycle), and power may be delivered to the active print head elements for an amount of time during the print head cycle based on the number of active print head elements. The amount of time may be chosen so that the total amount of energy delivered by each active print head element to an output medium during each print head cycle remains constant from print head cycle to print head cycle, regardless of the number of active print head elements in any particular print head cycle.

A correction factor may be used in the process of selecting the amount of time to activate print head elements during a particular print head cycle. In one aspect of the present invention, a parameter of the correction factor (or an approximation thereto) may be developed using a source target rendered on an output medium as an output target. The output target may be visually inspected and the value of the parameter may be derived from observations made during the visual inspection. For example, as described in more detail below, the source target may contain a first and second plurality of source regions having the same intensity (e.g., gray level). Pixels in the first plurality of source regions are arranged so that a first predetermined number of heating elements are active when the first plurality of source regions are rendered on the output medium as a first plurality of output regions. The first plurality of source regions are rendered on the output medium using a constant duty cycle. Pixels in the second plurality of source regions are arranged so that a second predetermined number of heating elements are active when the second plurality of source regions are rendered on the output medium as a second plurality of output regions. The second plurality of source regions are rendered on the output medium using a plurality of duty cycles (e.g., as described below with respect to steps 708 and 728). The second plurality of output regions therefore have a variety of blacknesses.

The output target may be visually inspected to identify one of the second plurality of output regions whose blackness most closely matches the blackness of the first plurality of output regions. The second plurality of output regions may be located near the first plurality of output regions to facilitate such identification. The parameter of the correction factor may be determined based on the selected one of the second plurality of output regions, as described in more detail below.

Additional aspects and particular embodiments of the present invention and advantages of such embodiments will now be described in more detail.

Various kinds of conventional printers exist for printing digital images on physical output media, such as paper. Such printers include, for example, dot-matrix printers, plotters (such as pen plotters, flatbed plotters, drum plotters, desktop plotters, and electrostatic plotters), laser printers, inkjet printers, thermal-transfer printers, and dye sublimation printers.

Thermal-transfer printers contain a linear array of heating elements spaced very close together (e.g., 84.7 microns) which typically transfer colored pigments in wax from a donor sheet to plain paper. The wax-coated donor and plain paper are drawn together over the strip of heating elements, which are selectively heated to cause the pigment transfer. For color printing, the wax on the donor roll may be pigmented into alternating cyan, magenta, yellow, and black strips, each of a length equal to the paper size.

Dye sublimation printers are similar to thermal-transfer printers, except that the heating and dye transfer process permits 256 intensities each of cyan, magenta, and yellow to be transferred, creating high-quality full-color images with a spatial resolution typically of 300 dots per inch (dpi). Although this process is slower than wax transfer, the quality of the resulting output is higher. Thermal-transfer printers, dye sublimation printers, and other printers that use thermal energy to deposit ink or wax on an output medium are referred to herein as thermal printers.

Referring to FIG. 1A, in a conventional bilevel thermal printer, a print head 100 includes a linear array of heating elements 102*a–d* (also referred to herein as "print head elements"). Although only four heating elements 102*a–d* are shown in FIG. 1A, it should be appreciated that a typical thermal print head includes a large number of small heating elements that are closely spaced at, for example, 300 elements per inch. Although the print head 100 in block diagram form in FIG. 1A is shown printing spots of a single color (such as black), thermal printers may have multicolor donor ribbons capable of printing spots of multiple colors. Furthermore, it should be appreciated that the heating elements 102*a–d* in the print head 100 may be of any shape and size, and may be spaced apart from each other at any appropriate distances and in any configuration.

The thermal print head 100 typically produces output on an output medium 104 (such as plain paper) as follows. For purposes of illustration, only a portion of the output medium 104 is shown in FIG. 1A. The output medium 104 moves underneath the print head 100 in the direction indicated by arrow 106. Delivering power to a particular print head element heats the print head element. When the element's temperature passes some critical temperature, it begins to transfer pigment (ink or wax) to the area of the output medium 104 that is currently passing underneath the heating element, creating what is referred to herein as a spot, or dot. The print head element will continue to transfer pigment to the output medium for as long as power is delivered to the print head element, and the temperature is above the critical temperature. A larger spot (or dot) may therefore be printed by delivering power to the print head element for a longer period of time. These larger spots are often referred to as "dots." A print head element to which power is being delivered is referred to herein as an "active" print head element. If no power is being delivered to a print head element, the print head element will not transfer pigment to the area of the output medium passing beneath it. Such a print head element is referred to herein as an "inactive" print head element.

A printer controller (not shown) inside the thermal printer is capable of selectively delivering power to any combination of the print head elements 102*a–d* at any particular time. Printer controllers in conventional thermal printers divide time into equal intervals of duration $T_c$, each of which is referred to herein as a "print head cycle." In some conventional thermal printers, the amount of time for which an active print head element is active does not vary from print head cycle to print head cycle. Typically, a print head element that is active during a particular print head cycle is active for all or substantially all of the print head cycle.

Figure 1B:
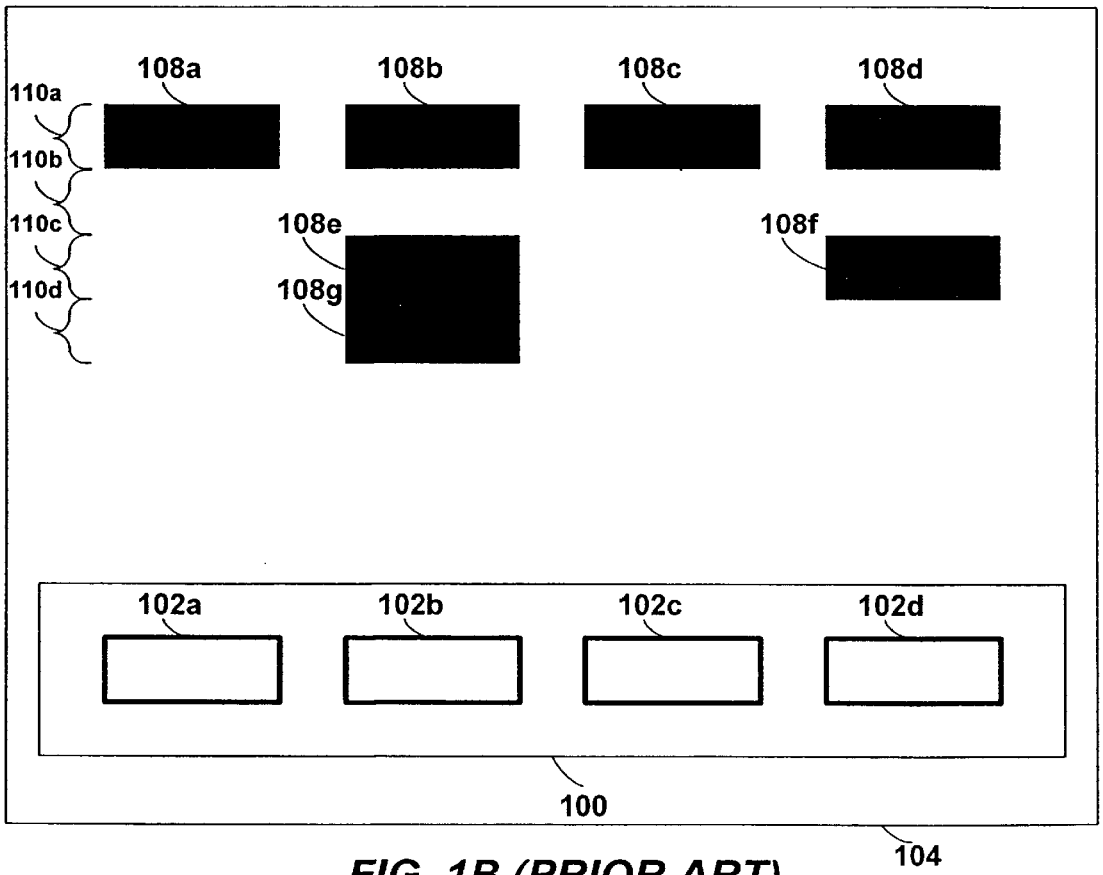
FIG. 1B (PRIOR ART)
FIG. 1B is a block diagram of spots printed on an output medium by a conventional thermal-transfer print head.
Figure 3A:
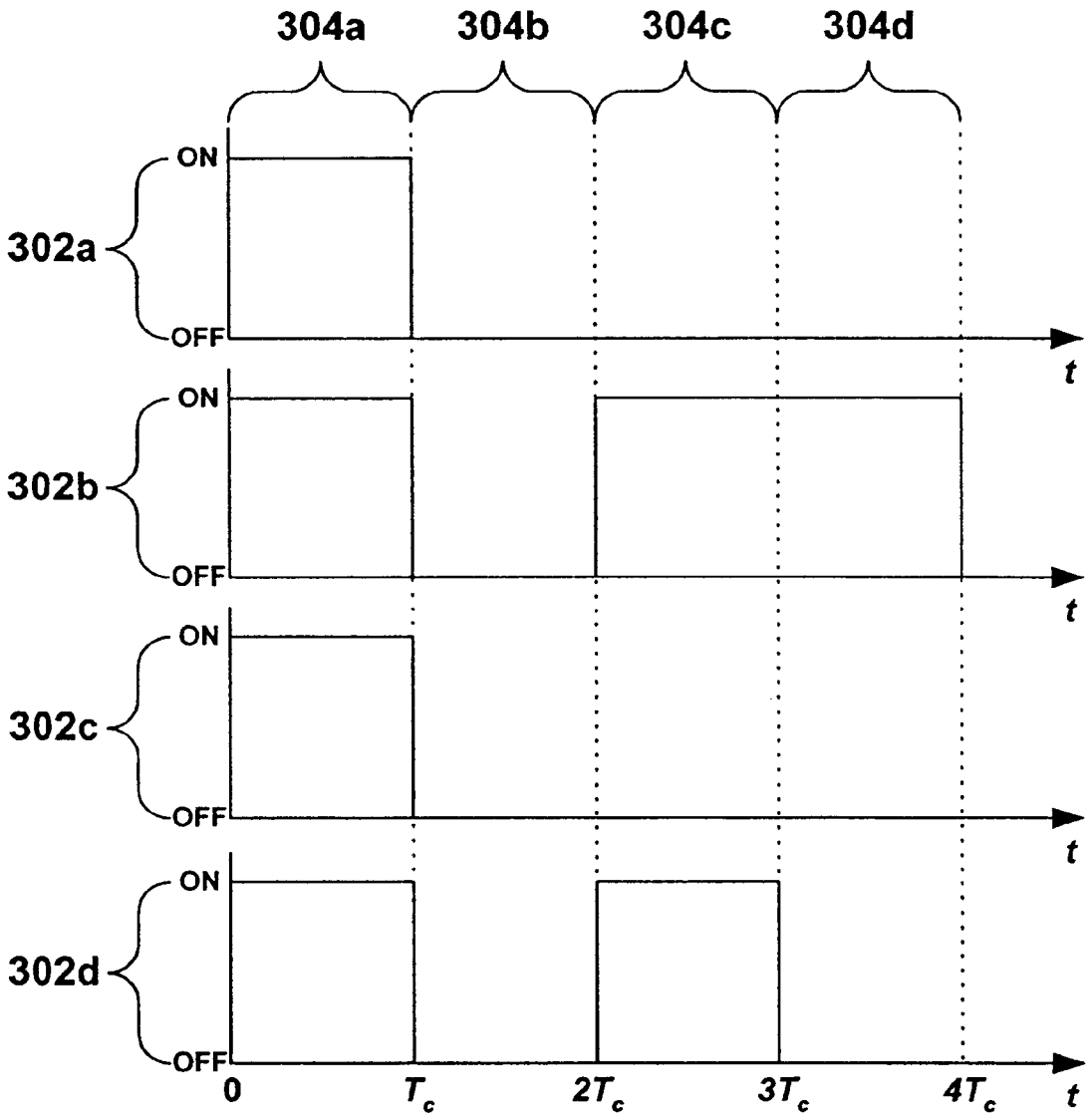
FIG. 3A (PRIOR ART)
FIG. 3A includes graphs of activation patterns of conventional thermal print head elements over time.

For example, referring to FIG. 1B, an example of a pattern of spots 108*a–g* printed by the print head 100 on the output medium 104 is shown. Referring to FIG. 3A, graphs 302*a–d* are shown of activation patterns of the print head elements 102*a–d* that resulted in printing the spots 108*a–g*. For example, graph 302*a* corresponds to the pattern of activation of the print head element 102*a* over time, graph 302*b* corresponds to the pattern of activation of the print head element 102*b* over time, and so on. The horizontal axes of graphs 302*a–d* represent time, which is subdivided into four equal print head cycles 304*a–d* (each of duration $T_c$). The vertical axes of each of the graphs 302*a–d* have two values, ON and OFF, indicating whether the corresponding print head element is active or inactive, respectively. Note that the values ON and OFF are merely binary values chosen for purposes of example and are not intended to represent the amount of power delivered to the print head elements 102*a–d*.

Referring again to FIG. 1B, the output medium 104 is shown after the print head 100 has produced output for the four print head cycles 304*a–d* shown in FIG. 3A. Each of the rows 110*a–d* contain spots that were printed during a single one of the print head cycles 302*a–d*. For example, consider the first print head cycle 304*a*. As shown in FIG. 3A, all four print head elements 102*a–d* were active during print head cycle 304*a*. As a result, as shown in FIG. 1B, four spots 108*a–d* were output by the print head 100 in the first row 110*a*, one spot by each of the print head elements 102*a–d*. As shown in FIG. 3A, none of the four print head elements 102*a–d* was active during the second print head cycle 304*b*. As a result, as shown in FIG. 1B, no spots were output in the second row 110*b*. Similarly, the correlation between the graphs 302*a–d* and the spots 108*e*, 108*f*, and 108*g* can readily be seen by reference to FIG. 3A and FIG. 1B.

It should therefore be understood in general how a conventional thermal printer may produce desired patterns of spots on the output medium 104 by selectively activating thermal print head elements 102*a–d* during successive print head cycles. More specifically, referring to FIG. 2, a schematic circuit diagram of print head circuitry 200 that is typically used to selectively deliver power to print head elements 102*a–d* is shown. Each of the plurality of print head elements 102*a–d* (FIGS. 1A–1B) is typically implemented as a resistor. For example, referring to FIG. 2, resistors 208*a–d*, each having a resistance R, correspond to the plurality of print head elements 102*a–d*.

Figure 2:
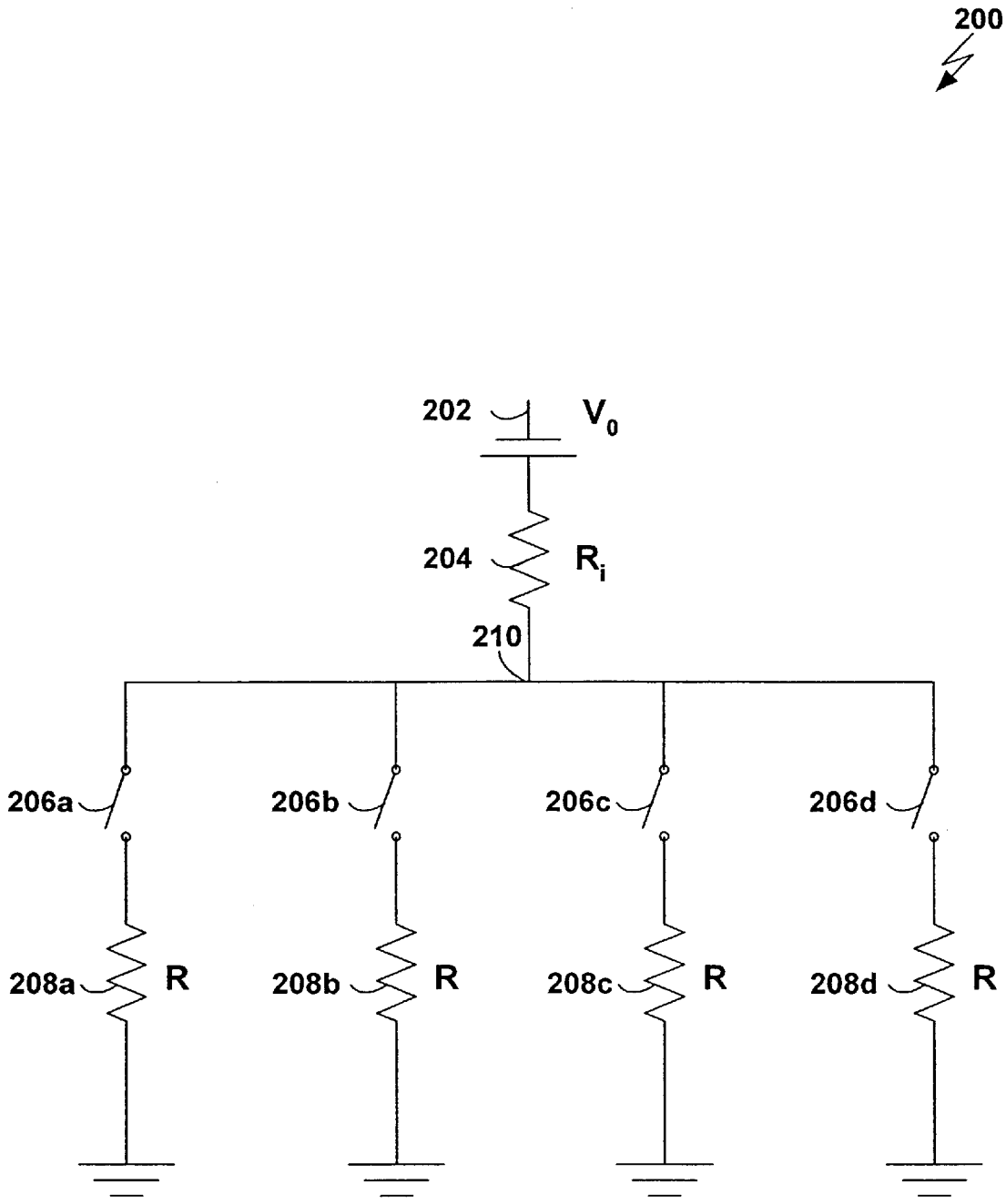
FIG. 2 is a circuit diagram of circuitry used in a conventional thermal print head element.

As shown in FIG. 2, print head element resistors 208*a–d* are wired in parallel with each other. A power source 202 having voltage $V_0$ provides power to the print head element resistors 208*a–d* over common resistor 204 having resistance $R_i$. As shown in FIG. 2, common resistor 204 is wired in series with the group of print head element resistors 208*a–d*. It should be appreciated that thermal print heads typically include other circuitry and structural elements that are well known to those of ordinary skill in the art. The simplified circuitry 200 is shown in FIG. 2 for ease of illustration and explanation.

Referring again to FIG. 2, the circuitry 200 may be used to enable the selective delivery of power to individual print head elements in accordance with the techniques described above. In particular, switches 206*a–d*, wired in series with resistors 208*a–d*, respectively, allow power to be selectively delivered to any combination of the resistors 208*a–d* during each print head cycle. For example, closing switch 206*a* completes a circuit from power source 202 through resistor 208*a* to ground, thereby allowing power to be delivered from power source 202 to resistor 208*a* for as long as switch 206*a* is closed. To selectively activate a desired combination of print head elements, the print head controller closes and opens corresponding ones of the switches 206*a–d*. Power is thereby delivered only to the ones of the resistors 208*a–d* connected through closed ones of the switches 206*a–d*.

For example, consider again the third print head cycle 304*c* illustrated in FIG. 3A. Print head elements 102*b* and 102*d* may be activated during print head cycle 304*c* by closing switches 206*b* and 206*d* during print head cycle 304*c*, while print head elements 102*a* and 102*c* may be deactivated during print head cycle 304*c* by opening switches 206*a* and 102*c* during the print head cycle 304*c*.

Having described generally how conventional thermal printers produce spots on an output medium, the manner in which conventional thermal printers render digital images is now described in more detail. A digital image is a two-dimensional array of pixels having r rows and c columns. The digital value of each pixel specifies an output characteristic of the pixel, such as its desired intensity or blackness. For example, each pixel in a grayscale digital image may have an 8-bit digital value (having a range of zero to 255) in which zero represents black, 255 represents white, and intermediate values represent intermediate shades of gray.

Each pixel in a particular column of the digital image is typically printed by a single one of the heating elements 102*a–d* of the thermal print head 100. The digital value of each pixel is used to determine how much energy the corresponding print head element should deliver to the output medium 104 when printing the pixel—the higher the digital value, the greater the energy that should be delivered to the output medium 104 to print the pixel. The amount of pigment transferred by a print head element to the output medium 104 is proportional to the energy delivered by the print head element. As a result, providing more energy to a print head element within a particular time interval will increase the density of the transferred pigment, resulting in an area that appears darker than one printed during the same time interval with less energy. This may be achieved by having either darker spots or larger dots.

Since different pixels in a particular row may have different digital values, the amount of energy to be delivered by one print head element may differ from the amount of energy to be delivered by another print head element when printing pixels in the same row of the digital image. This is typically accomplished by allocating a fixed time interval, designated herein as $T_p$, during which a row of pixels is printed. Since each pixel within the row may require a different amount of energy to print, each print head element may be activated for a different fraction of the interval $T_p$. To achieve this, the interval $T_p$ is typically further divided into subintervals of duration $T_c$. These subintervals are the "print head cycles" described above. For example, there may be 300 print head cycles per row, in which case $T_c$ is equal to $T_p/300$.

As described above, it is typically possible to activate and deactivate any combination of print head elements for any print head cycle. Ideally, then, each pixel in a digital image may be printed with the correct blackness by delivering power to the print head element responsible for printing that pixel for a number of print head cycles that is a monotonic function of the digital value of the pixel.

The technique just described, in which a pixel having a particular digital value is printed by activating the corresponding heating element for a number of print head cycles corresponding to the pixel's digital value, assumes that the amount of power P delivered to an active print head element does not vary among active print head elements or from print head cycle to print head cycle. In other words, the correct pixel blacknesses will be produced if a constant power P is delivered to any active print head element within any print head cycle, thereby delivering a constant amount of energy E to the output medium for each active heating element during each print head cycle.

Some conventional techniques for printing digital images on thermal printers are now described in more detail. The pattern of active and inactive print head elements during a particular print head cycle may be represented as a one-dimensional array of bits. For example, a one may represent an active print head element and a zero may represent an inactive print head element. As used herein, a binary zero is equivalent to a logical value of FALSE and a binary one is equivalent to a logical value of TRUE. Using such a scheme, the array of bits corresponding to a particular print head cycle is serially loaded through a data line into a first data buffer in the thermal print head prior to the beginning of the print head cycle.

Figure 3B:
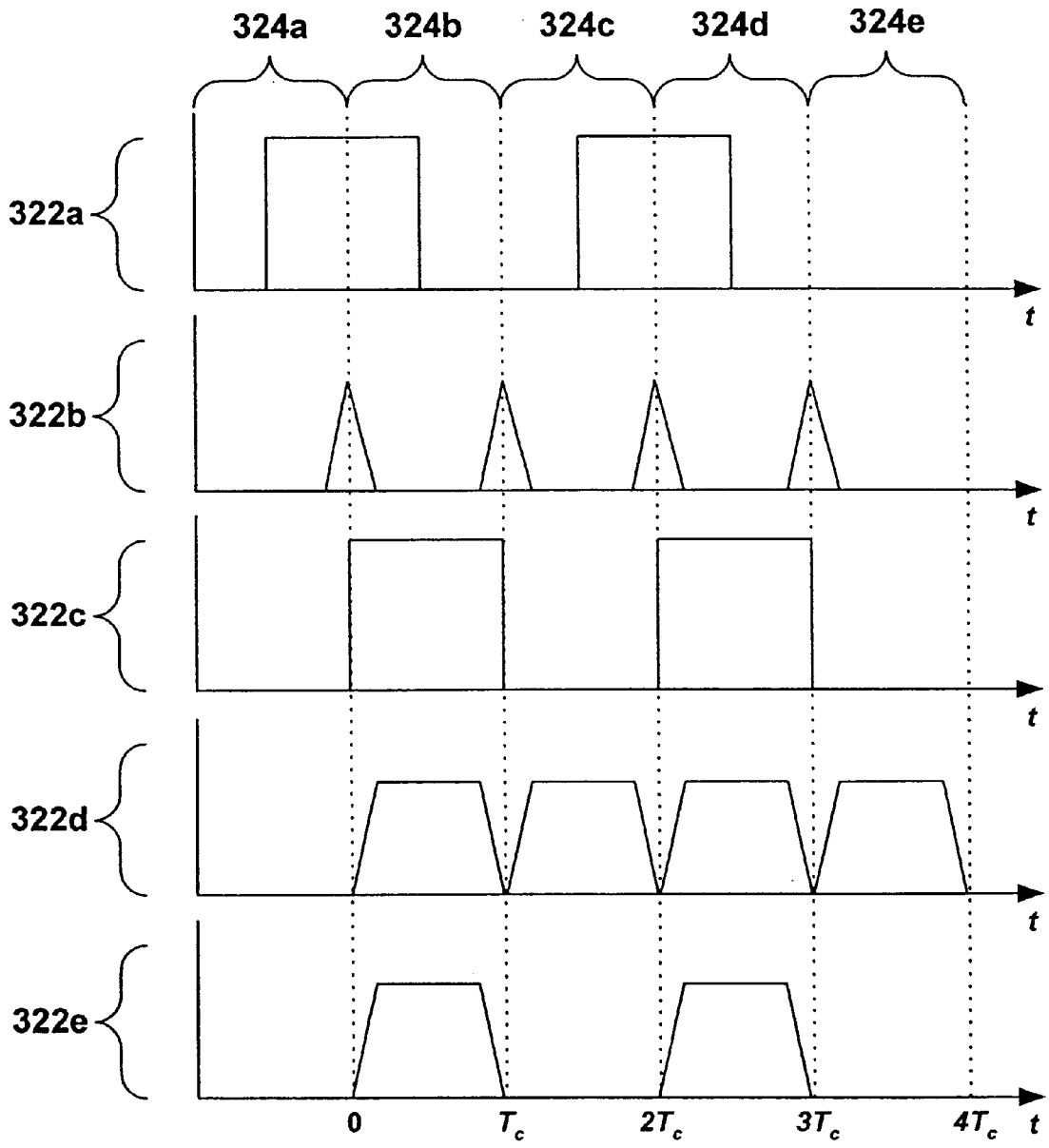
FIG. 3B (PRIOR ART)
FIG. 3B includes graphs of various signals used by conventional thermal print head elements.

For example, referring to FIG. 3B, graphs 322*a–e* are shown of various signals that are used in the process of printing a digital image using a conventional thermal printer. The horizontal axes of graphs 322*a–e* represent time (subdivided into equal intervals of duration $T_c$), while the vertical axes represent voltage. Graph 322*a* is a graph of the first data buffer into which data for print head element 102*d* is loaded. Referring back to FIGS. 1B and 3A, print head element 102*d* is to be active (and therefore print a spot) during print head cycle 324*a* (corresponding to print head cycle 304*a* in FIG. 3A). Therefore, data is loaded into the first data buffer during print head cycle 324*a*, as shown in graph 322*a*.

Graph 322*b* represents a periodic latch signal that is used to latch data from the first data buffer into a second data buffer. Data are transferred from the first data buffer to the second data buffer when the latch signal is high. As shown in graph 322*b*, the latch signal peaks at approximately the beginning of each of the print head cycles 324*b–e*. Note that the particular latch signal shown in graph 322*b* is shown merely for purposes of example, and that suitable latch signals may have other waveforms and may peak before or after the beginning of the print head cycle.

Graph 322*c* is a graph of the second data buffer corresponding to print head element 102*d*. As shown in FIG. 3B, the second data buffer may begin low, and changes state when the latch signal goes high, causing data in the first data buffer to be transferred into the second data buffer. The second data buffer retains its value until the latch signal causes it to change by loading a new value.

Graph 322*d* is a graph of a strobe signal used to control print head element 102*d* (and the other print head elements 102*a* and 102*c–d*). The strobe signal has a value of either TRUE (high) or FALSE (low). The period of the strobe signal is roughly equal to the duration of a print head cycle. A logical AND is continuously performed on the strobe signal and each value in the second data buffer. Each print head element is activated for as long as the result of the logical AND of the strobe signal and the corresponding print head element's data value in the second data buffer is TRUE.

For example, graph 322*e* is a graph of the voltage drop across print head element 102*d*. It can be seen that print head element 102*d* is activated during the portion of print head cycle 324*b* in which the second data buffer (graph 322*c*) and the strobe signal (graph 322*d*) are high. Similarly, it can be seen that print head element 102*d* is inactive for the duration of print head cycle 324*c*, since the second data buffer has a value of FALSE throughout print head cycle 324*c*, causing the result of the logical AND described above to be FALSE for the duration of print head cycle 324*c*.

More generally, using the techniques just described, those print head elements that have a one (TRUE) stored in their corresponding second buffer draw current while the strobe signal is TRUE and continue to do so until either: (1) the strobe signal becomes FALSE, or (2) the value stored in the second data buffer changes to zero (FALSE).

As shown in FIG. 3B, the strobe signal used in conventional thermal printers is a signal having a constant period. As a result, an active print head element is always active for the same amount of time during a print head cycle. For example, as shown in graph 322*e*, print head element 102*d* is active in both print head cycles 324*b* and 324*d*, and is active for the same amount of time during each of these print head cycles. Furthermore, the strobe signal is typically high for substantially all of the print head cycle, as shown in graph 322*d*. The strobe signal is typically low (FALSE) only for a short period of time needed to latch data from the first data buffer into the second data buffer. As a result, active print head elements in conventional thermal printers are typically active for substantially all of the print head cycle in which they are active.

It should be apparent that the techniques just described may be used to produce output such as that shown in FIG. 1B, corresponding to the activation patterns shown in FIG. 3A.

It has been assumed in the description thus far that a constant power P is delivered to each active print head element during each print head cycle. In conventional thermal printers, however, the actual amount of power that is delivered to a particular active print head element during a particular print head cycle varies based on the number of print head elements that are active during that print head cycle. More specifically, in conventional thermal printers the amount of power that is provided to (and, therefore, the amount of energy that is delivered by) an individual print head element decreases as the total number of contemporaneously active print head elements 102*a–d* increases. As described in more detail below, this results from the circuitry 200 employed to deliver power to the print head elements 102*a–d*.

When a particular one of the print head elements 102*a–d* receives less power, it transfers less colorant to the output medium, thereby resulting in an unintended and undesirable decrease in density of the region of the output image being printed. This decrease in density is perceived as a decrease in darkness when viewed by the human eye at a macroscopic level. Since the number of contemporaneously active print head elements will typically fluctuate while printing a digital image, the resulting printed image will have undesired variations in reflectance that do not accurately reflect the variations in digital pixel values in the source image being printed.

More specifically, let R' be the total resistance of common resistor 204 (having resistance $R_i$) and the parallel print head element resistors 208*a–d* (each having resistance R). Let n refer to the number of print head elements that are active during a particular print head cycle. In other words, n is the number of switches 206*a–d* that are closed during a particular print head cycle. The combined resistance of all active print head element resistors is R/n, since the resistors 208*a–d* are wired in parallel. Since the common resistor 204 is wired in series with the print head element resistors 208*a–d*, the total resistance R' may be expressed by Equation 1:

$$R' = R_i + R/n \qquad \text{Equation 1}$$

The current I drawn through common resistor $R_i$ is expressed by Equation 2:

$$I = \frac{V_0}{R'} = \frac{V_0}{R_i + R/n} \qquad \text{Equation 2}$$

The total voltage V' seen by the print head element resistors 208*a–d* (at point 210) is expressed by Equation 3:

$$V' = V_0 - IR_1 \qquad \text{Equation 3}$$

Factoring out $V_0$, substituting for $R_i$ using Equation 1, and simplifying the results leads to Equation 4:

$$V' = \frac{V_0}{1 + \frac{nR_i}{R}} \qquad \text{Equation 4}$$

It can be seen from Equation 4 that the power supply voltage V' seen by the print head element resistors 208*a–d* at point 210 decreases as the number n of active print head elements increases, resulting in the undesirable consequences described above.

Figure 4:
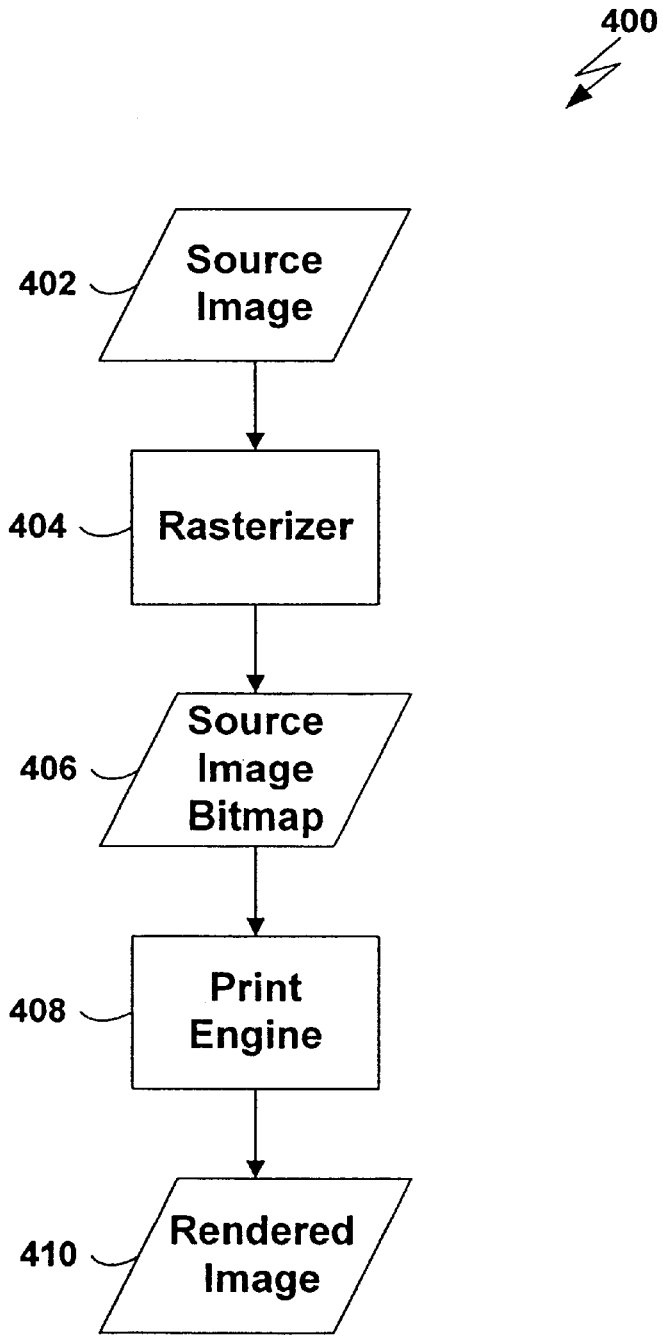
FIG. 4 is a dataflow diagram illustrating a context in which one embodiment of the present invention may be used.

Referring to FIG. 4, a dataflow diagram 400 is shown that illustrates one context in which various embodiments of the present invention may be used. A source image 402 may be any image that is desired to be output on an output medium.

The source image 402 may, for example, be a photograph, a digital photograph, or other digital image. More generally, the source image 402 may be either a continuous-tone image or a discrete-tone image, and may be stored on any medium, such as paper, film, or a computer-readable medium such as a computer memory or file system. The source image 402 is provided to a rasterizer 404, which produces a source image bitmap 406 corresponding to the source image 402. The source image bitmap 406 is a digital image that is in a form suitable for rendering by a print engine 408 of a printer (not shown). For example, in one embodiment the source image bitmap 406 is an array of pixels that have a one-to-one correspondence with pixels that may be rendered by the printer. The rasterizer 404 may perform a variety of intermediate steps in addition to converting the source image 402 from analog to digital form, if necessary. Functions performed by the rasterizer 404 and the print engine 408 may be embodied in any form, such as in hardware, software, firmware, ASICs, or any combination thereof. Furthermore, functions performed by the rasterizer and the print engine 408 may be performed by a computer, printer, other device, or any combination thereof.

Print engine 408 controls the printer to render the source image bitmap 406 on an output medium as a rendered image 410. In particular, print head engine 408 controls the print head elements 102*a–d* to output spots comprising the pixels in the source image bitmap 406. As described in more detail below, in various embodiments of the present invention the print engine 408 controls the amount of time that the print head elements 102*a–d* are activated so that a constant amount of energy is delivered to activated print head elements for each spot printed.

Figure 5:
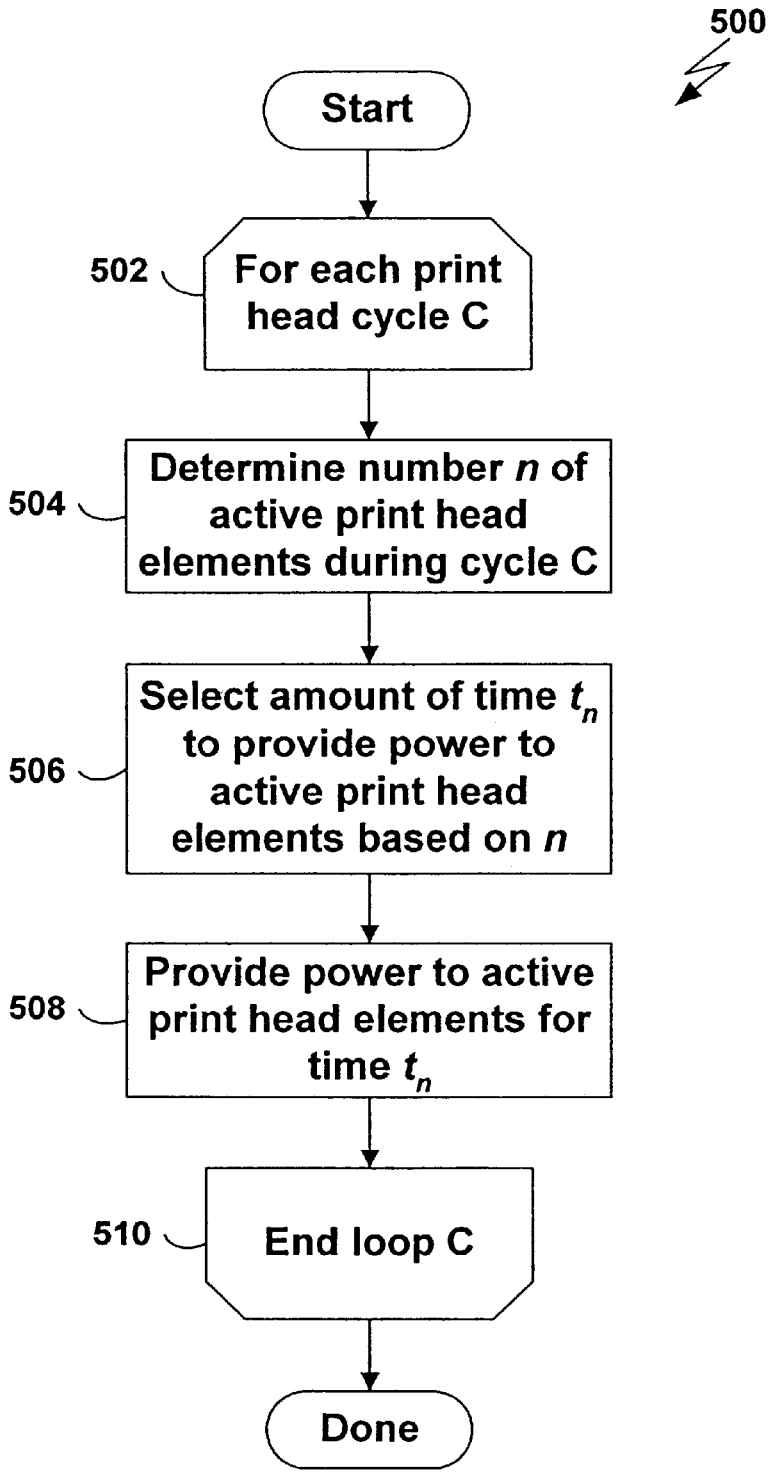
FIG. 5 is a flow chart of a process that is used in one embodiment of the present invention to provide a predetermined amount of energy to each activate thermal print head element in each of a plurality of print head cycles.

As described above, in one aspect of the present invention, a method is provided for providing a desired amount of energy to each of a plurality of thermal print head elements that are active within a particular time interval (such as a print head cycle), regardless of the number of print head elements that are active during that time interval. Referring to FIG. 5, a flow chart is shown of a process 500 that is used in one embodiment of the present invention to provide the desired amount of energy to each of a plurality of active print head elements during a particular print head cycle. The process 500 may, for example, be performed by the print engine 408 to improve the quality of the rendered image 410 (FIG. 4).

Assume that there is a predetermined number of print head cycles required to render the rendered image 410 on the output medium. The number of print head cycles required may, for example, be equal to the number of rows in the source image bitmap 406 or an integral multiple thereof. Referring to FIG. 5, the process 500 enters into a loop for each print head cycle C required to render the rendered image 410 (step 502).

The process 500 determines the number n of print head elements that are to be active during the current print head cycle C (step 504). The number n may be determined in any of a variety of ways. For example, as described above, in conventional thermal printers, an array of bits (referred to herein as "print head element data") is typically used to specify which print head elements are to be active and which print head elements are to be inactive in a particular print head cycle. As shown and described above with respect to FIG. 3B, print head element data are loaded into a first data buffer and then latched into a second data buffer using a latch signal prior to the beginning of the print head cycle. The number n of print head elements that are to be active during the print head cycle may be determined simply by summing the bits in the print head element data as they are loaded into the first data buffer (in which a one corresponds to an active print head element and a zero corresponds to an inactive print head element).

It should be appreciated that the process 500 shown in FIG. 5 is not limited to use with any particular print head element data or to use with print head element data that is generated using any particular method. Rather, the process 500 may be used in conjunction with any print head element data (i.e., any combination of active and inactive print head elements during each of the print head cycles C) that is generated or selected in any manner.

The process 500 selects an amount of time $t_n$ to provide power to the n active print head elements based on the number n (step 506). Various techniques for selecting $t_n$ are described in more detail below. The process 500 provides an amount of power $P_n$ to the n active print head elements for the amount of time $t_n$ (step 508). Step 508 may be accomplished in any of a variety of ways. For example, a strobe signal may be provided that becomes TRUE at or near the beginning of the print head cycle C, remains TRUE for time $t_n$, and then becomes FALSE. A logical AND may be continuously performed on the strobe signal and each of the values in the second data buffer described above. The result of the logical AND for each print head element is used to either open or close the corresponding one of the switches 206*a–d*, where a result of TRUE indicates that the switch should be closed and a result of FALSE indicates that the switch should be open. Power is thereby provided to each of the active print head elements for time $t_n$.

The remainder of the rendered image 410 is rendered by repeating steps 502-506 for the remaining print head cycles C (step 510).

Figure 3C:
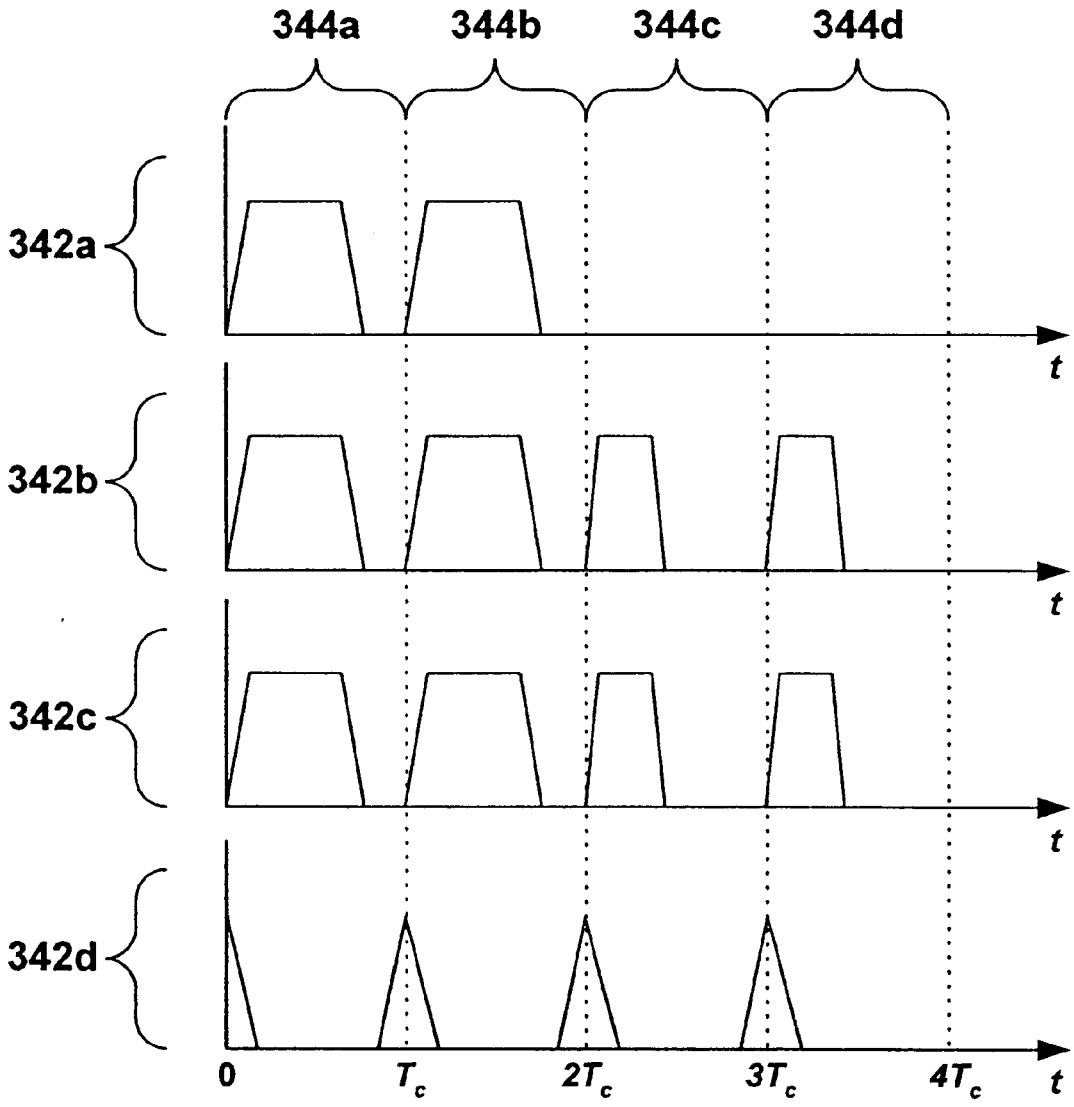
FIG. 3C includes graphs of various signals used by a thermal printer in one embodiment of the present invention.

For example, referring to FIG. 3C, graphs 342*a–d* are shown of signals that may result from use of the process 500. As described above with respect to FIG. 3B, the horizontal axes of graphs 342*a–d* represent time and the vertical axes represent voltage. Graphs 342*a* and 342*b* are graphs of the voltage drop across print head elements 102*a* and 102*b*, respectively, over the course of four print head cycles 344*a–d*. Assume for purposes of example that print head element 102*a* is active for print head cycles 344*a–b* and inactive for print head cycles 344*c–d*. Further assume for purposes of example that print head element 102*b* is active in each of print head cycles 344*a–d*. Graph 342*d* represents a periodic latch signal that is identical to the latch signal 322*b* described above with respect to FIG. 3B.

Graph 342*c* represents a strobe signal that may be used in conjunction with the process 500 to provide power to the print head elements 102*a–b* for the appropriate amount of time $t_n$ during each of the print head cycles 344*a–d*. Consider, for example, print head cycle 344*a*, during which both print head elements 102*a–b* are active. The strobe signal remains TRUE for a duration $t_n$, where n=2. Since both print head elements 102*a–b* are active during print head cycle 344*a*, corresponding graphs 342*a–b* indicate that power is delivered to both print head elements 102*a–b* while the strobe signal is TRUE. The same is true for print head cycle 344*b*.

Turning to print head cycles 344*c* and 344*d*, only print head element 102*b* (graph 342*b*) is active. As a result, the voltage drop across print head element 102*b* is higher than that of printhead cycles 344*a* and 344*b*. The strobe signal remains TRUE during each of these print head cycles for a duration $t_n$, where n=1. As indicated by graph 342*c* and because of the higher voltage drop across 102*b*, the value of $t_n$ when n=1, is less than the value of $t_n$ when n=2. Therefore, the strobe signal remains TRUE for a shorter period of time during each of print head cycles 344*c–d* than during print head cycles 344*a–b*. As shown in graph 342*b*, print head element 102*b* is therefore active for a shorter period of time during each of print head cycles 344*c–d* than during print head cycles 344*a–b*. It should be appreciated that the constant amount of energy $E_0$ may therefore be provided to each of the print head elements 102*a–b* during each of the print head cycles 344*a–d* in which each print head element is active.

It should be appreciated that the waveforms illustrated in FIGS. 3A–3C are not drawn to scale and are provided merely for purposes of example. For example, the duration of each pulse of the strobe signal illustrated in graph 342*c* of FIG. 3C is not necessarily proportional to the corresponding value of $t_n$. Rather, the strobe signal illustrated in graph 342*c* is provided merely to illustrate that the duration of the strobe signal pulse decreases as the value of n decreases.

Examples of various techniques for selecting the duration $t_n$ (FIG. 5, step 506) are now described in more detail. As mentioned above, the duration $t_n$ may be selected so that the same amount of energy is delivered to each active print head element during a particular time interval (such as a print head cycle), regardless of the number n of print head elements that are active during that time interval.

Let $E_0$ be the total amount of energy that is desired to be output by each active print head element during a print head cycle in order to produce a spot having a desired density. If $P_0$ is the power delivered to each active print head element when $R_i$ is zero, and to is the amount of time for which power $P_0$ must be delivered to a print head element to produce energy $E_0$, then energy $E_0$ is shown in Equation 5:

$$E_0=P_0t_0 \qquad \text{Equation 5}$$

Since $P_0$ is equal to $V_0^2/R$ when $R_i$ is zero, Equation 5 can be rewritten as Equation 6:

$$E_0=\frac{V_0^2}{R}t_0 \qquad \text{Equation 6}$$

Let $P_n$ refer to the amount of power that is delivered to a single active print head element when n print head elements are contemporaneously active. $P_n$ is therefore given by Equation 7:

$$P_n=\frac{V_0^2}{\left(1+\frac{nR_i}{R}\right)^2R} \qquad \text{Equation 7}$$

As can be seen from Equation 7, $P_n$ decreases as the number n of contemporaneously active print head elements increases. If $t_n$ is the amount of time for which power is delivered to n contemporaneously active print head elements during a print head cycle, then the total amount of energy $E_n$ produced by each of the n print head elements during the print head cycle is shown by Equation 8:

$$E_n=P_nt_n \qquad \text{Equation 8}$$

In one embodiment of the present invention, the time $t_n$ is chosen during each print head cycle so that the total amount of energy $E_n$ produced during a print head cycle by each of the n active print head elements is equal to the desired amount of energy $E_0$, as shown in Equation 9:

$$E_n=E_0 \qquad \text{Equation 9}$$

In other words, the time $t_n$ may be selected so that $E_n$ does not vary from print head cycle to print head cycle, regardless of changes in the value of n (the number of active print head elements) from print head cycle to print head cycle. Therefore, if time $t_n$ is selected so that Equation 9 is satisfied, then the desired amount of energy $E_0$ may be output by each active print head element during each print head cycle regardless of the number n of contemporaneously active print head elements by providing power to each print head element for time $t_n$.

Substituting in values of $E_n$ and $E_0$ into Equation 9 leads to Equation 10:

$$\frac{V_0^2}{R\left(1+\frac{nR_i}{R}\right)^2}t_n=\frac{V_0^2}{R}t_0 \qquad \text{Equation 10}$$

Solving for $t_n$ gives Equation 11:

$$t_n=\left(1+\frac{nR_i}{R}\right)^2t_0 \qquad \text{Equation 11}$$

As described above with respect to FIG. 5, in one embodiment of the present invention, the desired amount of energy $E_0$ is delivered by each of n active print head elements during a particular print head cycle by selecting a value of $t_n$ (step 506) and providing power $P_n$ to each of the n active print head elements for time $t_n$ by making the strobe signal TRUE for time $t_n$ (step 508). It should be appreciated that the value of $t_n$ may, for example, be calculated in step 506 using Equation 11. Such a calculation may use as its inputs the values of n, $t_0$, $R_i$, and R. The calculation may, for example, use the ratio $R_i/R$ as an input instead of the individual values of $R_i$ and R.

Although step 506 (FIG. 5) may be implemented by calculating the duration $t_n$ on the fly (i.e., as the process 500 is being performed), such as by using Equation 11, above, this is not a limitation of the present invention. Rather, the duration $t_n$ may be calculated, generated, or selected in any of a variety of ways. Approximations to Equation 11 may be used if, for example, faster calculation of $t_n$ is desired. For example, if the ratio $NR_i/R$ is very small (e.g. less than 0.1), where N is the maximum number of print head elements that may be active in a single print head cycle, then the term $(nR_i/R)^2$ in the expansion of Equation 11 may be ignored, in which case Equation 11 may be approximated by Equation 12:

$$t_n=\left(1+\frac{2nR_i}{R}\right)t_0 \qquad \text{Equation 12}$$

For example, in one embodiment of the present invention, the ratio $R_i/R$ is approximately equal to $10^{-5}$, in which case Equation 12 may advantageously by used to calculate an approximation to $t_n$.

Alternatively, a lookup table may be pre-generated that contains values of $t_n$ indexed by the number n. When the value of n is determined (FIG. 5, step 504), the corresponding value of $t_n$ may be obtained (step 506) by looking it up in the lookup table. A smaller lookup table containing fewer than all possible values of $t_n$ may be used, and interpolation may be used to estimate values of $t_n$ that are not stored in the lookup table, or, the number, n, is scaled or bit-shifted so that it falls within the range of the lookup table. Various combinations of the techniques just described may also be used.

Various embodiments described above employ the following features: constant-duration print head cycles, a periodic latch signal (such as the latch signal shown in graph 342*d*) which rises at approximately the beginning of each print head cycle, and a strobe signal which rises at approximately the beginning of each print head cycle and remains high for time $t_n$. These particular features, however, are provided merely for purposes of example and do not constitute limitations of the present invention. For example, the features just described result in "dead time" between strobe signal pulses (as illustrated by the gaps between pulses of the strobe signal in graph 342*c*).

In one embodiment of the present invention, this "dead time" is eliminated by collapsing the strobe signal pulses so that each pulse of the strobe signal commences immediately after the preceding strobe signal pulse terminates. This may effectively produce one continuous strobe signal. Furthermore, a non-periodic latch signal is used in which the peak of each latch signal pulse is timed to substantially coincide with the initiation of a corresponding strobe signal pulse. The "dead time" between strobe signal pulses and between print head element "on" times may therefore be substantially or entirely eliminated. In this embodiment, the duration of the "on time" ($t_n$)for each print head element is still a function of the number of contemporaneously-active print head elements, and the value of $t_n$ for each print head element may be calculated in the same manner as described above. Those of ordinary skill in the art will appreciate how to implement this embodiment using the techniques described elsewhere herein.

As described above with respect to Equation 11, $t_n$ is a function of time $t_0$. The value of to may be chosen in any of a variety of ways. In one embodiment of the present invention, power is delivered to each active print head element during a portion of a print head cycle. In this embodiment, therefore, it is desired that $t_n$ not exceed $T_c$, the duration of a print head cycle, for any value of n. If N is the maximum number of print head elements that may be active in a single print head cycle, then the desired relationship between $t_N$ and $T_c$ is shown by Equation 13:

$$t_N \leq T_c \qquad \text{Equation 13}$$

As seen from Equation 11, $t_n$=f(n) $t_0$, where the value of f(n) is as shown in Equation 14:

$$f(n) = \left(1 + \frac{nR_i}{R}\right)^2 \qquad \text{Equation 14}$$

Based on Equation 14, the value of $t_N$ may be obtained by letting n=N in Equation 11, resulting in:

$$t_N = f(N)t_0 \qquad \text{Equation 15}$$

Solving for to leads to Equation 16:

$$t_0 = kt_N \qquad \text{Equation 16}$$

where k=1/f(N), as expanded in Equation 17:

$$k = \frac{1}{\left(1 + \frac{NR_i}{R}\right)^2} \qquad \text{Equation 17}$$

The value k is referred to herein as a "correction factor." By using Equation 13, we can rewrite Equation 16 as Equation 18:

$$t_0 \leq kT_c \qquad \text{Equation 18}$$

Therefore, in one embodiment of the present invention, a value of $t_0$ is chosen so that $t_0$ satisfies Equation 18. This may be accomplished by: (1) calculating, estimating, or otherwise selecting a value of k based on the known values of N and $R_i$/R, (2) selecting $kT_c$ based on the known values of k and $T_c$, and (3) selecting a value of $t_0$ that is less than or equal to $kT_c$, thereby satisfying Equation 18.

In one embodiment, the value of the $NR_i$/R term in Equation 18 is approximately equal to 0.1. This results in a value of k approximately equal to 0.826. If $T_c$ is equal to $1/300^{th}$ of a second (approximately 0.00333), then $kT_c$ is approximately equal to 0.00275 seconds. Any value for $t_0$ that is less than 0.00275 seconds may therefore be chosen to satisfy Equation 13, thereby ensuring that power will not be delivered to any print head element for longer than the duration of a print head cycle regardless of the number n of print head elements that are active during the print head cycle.

It should be appreciated that the techniques just described for selecting a value of $t_0$ are provided merely for purposes of example and do not constitute a limitation of the present invention. Rather, the value of $t_0$ may be chosen in other ways that fall within the scope of the claims.

As described above, $t_n$ may be calculated from the values of n, $t_0$, $R_i$, and R using Equation 11. Examples of techniques for obtaining values of n and $t_0$ are described above. All that remains for purposes of calculating $t_n$ is to obtain values of $R_i$ and R or to obtain a value for the ratio $R_i$/R, referred to herein as r. Examples of techniques for obtaining values of $R_i$, R, and the ratio r are now described in more detail.

In one embodiment of the present invention, the values of $R_i$ and R are measured in the circuitry 200 using standard techniques or are previously known based on knowledge of the circuitry 200. The ratio r may then be readily ascertained by dividing $R_i$ by R.

Calculation of $t_n$ using Equation 11, however, does not require that the individual values of $R_i$ and R be known, so long as the ratio $R_i$/R is known. Recalling that r is the ratio $R_i$/R, Equation 11 may be rewritten as Equation 19:

$$t_n = (1+nr)^2 t_0 \qquad \text{Equation 19}$$

In one embodiment of the present invention, the value of r or an approximation thereto is developed using a target rendered on an output medium. The target may be visually inspected and the value of r may be derived from observations made during the visual inspection.

Figure 6A:
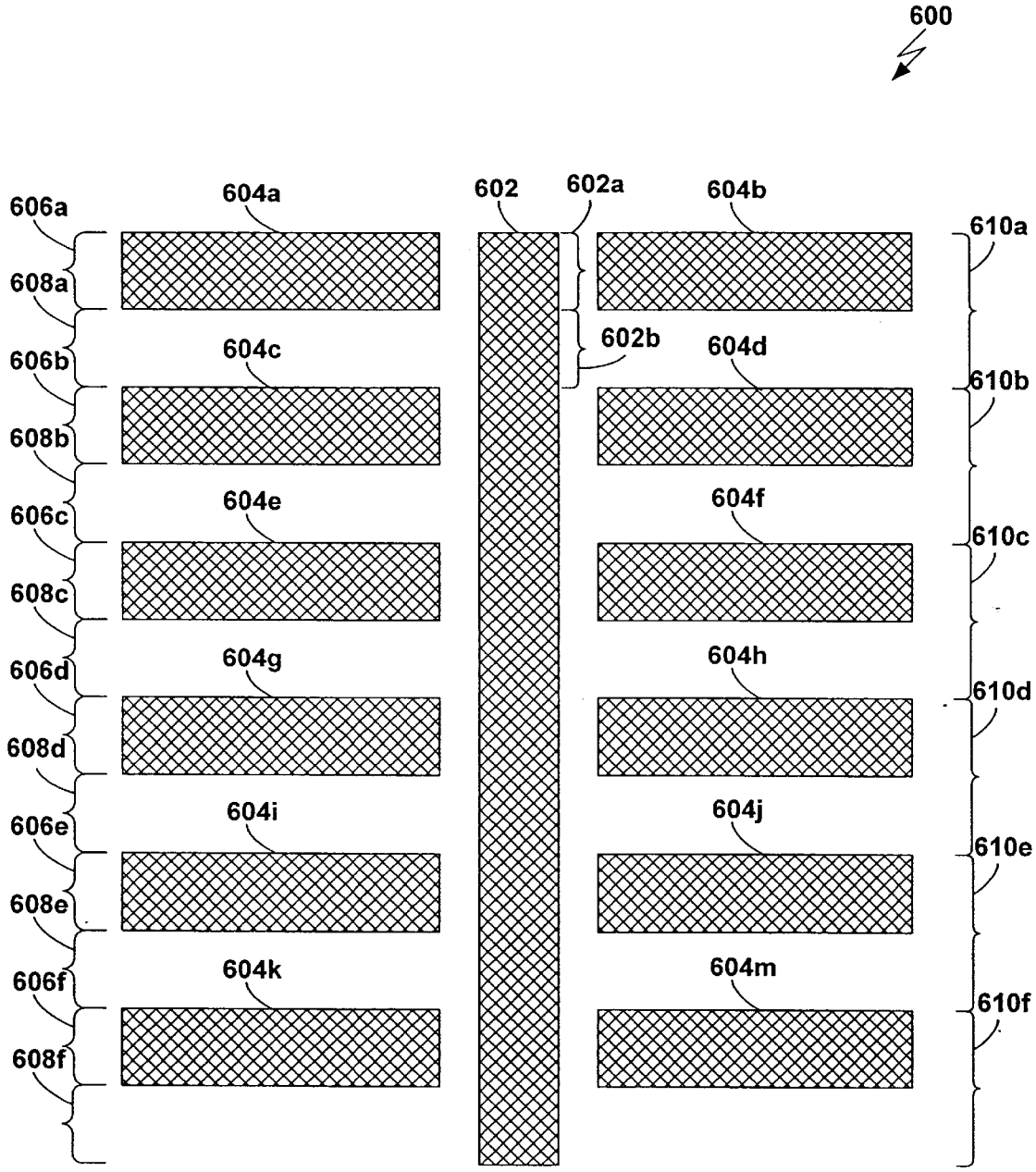
FIG. 6A is a diagram of a target in digital form that may be used in one embodiment of the present invention to estimate an amount of time to activate a thermal print head element.

More specifically, referring to FIG. 6A, a source target 600 is shown according to one embodiment of the present invention. The source target 600 is a digital image that may be stored, for example, in a computer-readable memory such as a Random Access Memory (RAM) or in a file on a hard disk drive. The source target 600 therefore includes a two-dimensional array of pixels. In one embodiment of the present invention, the target 600 is a grayscale image, in which case the digital value of each pixel in the target 600 specifies a level of gray. For example, if the target 600 is an 8-bit grayscale image, then each pixel may have a grayscale value ranging from 0 to 255.

The cross-hatch pattern used to illustrate the target 600 in FIG. 6A represents a particular level of gray, such as a grayscale value of 128 out of 255. As shown in FIG. 6A, all pixels of the striped bars of the source target 600 have the same digital value, specifying a single shade of gray. As described in more detail below, however, all pixels of target 600 may not appear to be the same shade of gray when the source target 600 is rendered on an output medium as an output target by a thermal printer. Rather, some pixels may appear darker or lighter than others. The source target 600 shown in FIG. 6A, however, is illustrated using a single shade of gray to indicate that the source target 600 is a digital image in which all pixels have the same digital value.

Figure 8:
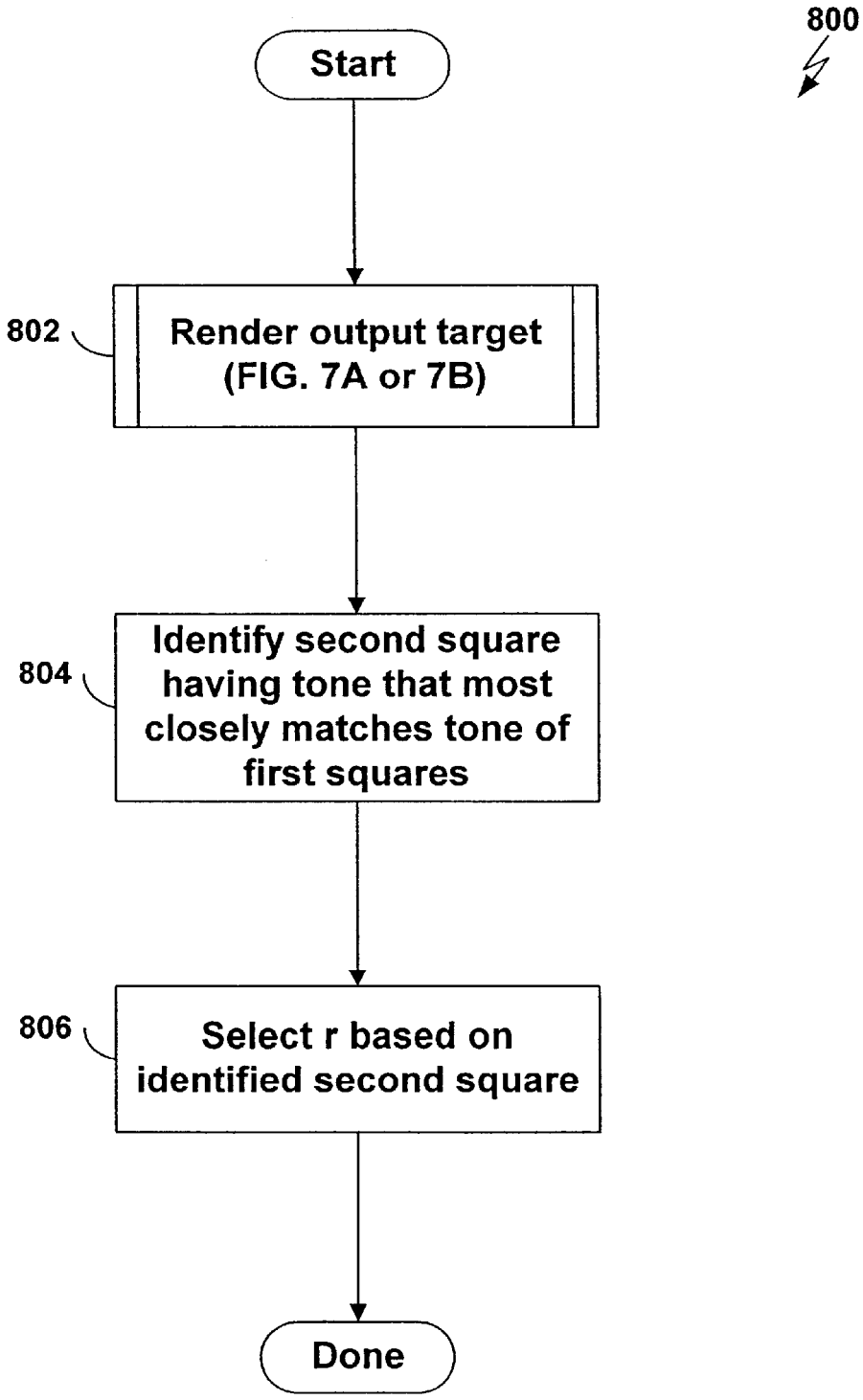
FIG. 8 is a flowchart of a method that is used to select a parameter of a voltage correction factor for thermal printing in one embodiment of the present invention.

The source target 600 includes a long, narrow bar 602 down the center, with a series of horizontal bars 604*a–m* flanking the vertical bar 602. The vertical bar 602 and each of the horizontal bars 604*a–m* is a two-dimensional array of pixels. The bars 602 and 604*a–m* may be of any width and height, but should at least be large enough to be clearly visible to the human eye when rendered on an output medium. Furthermore, the rendered appearance of the source target 600 that is advantageously used in the method described below with respect to FIG. 8 is more pronounced if the horizontal bars 604*a–m* are substantially wider than (and therefore include many more pixels in each row than) the vertical bar.

Figure 7A:
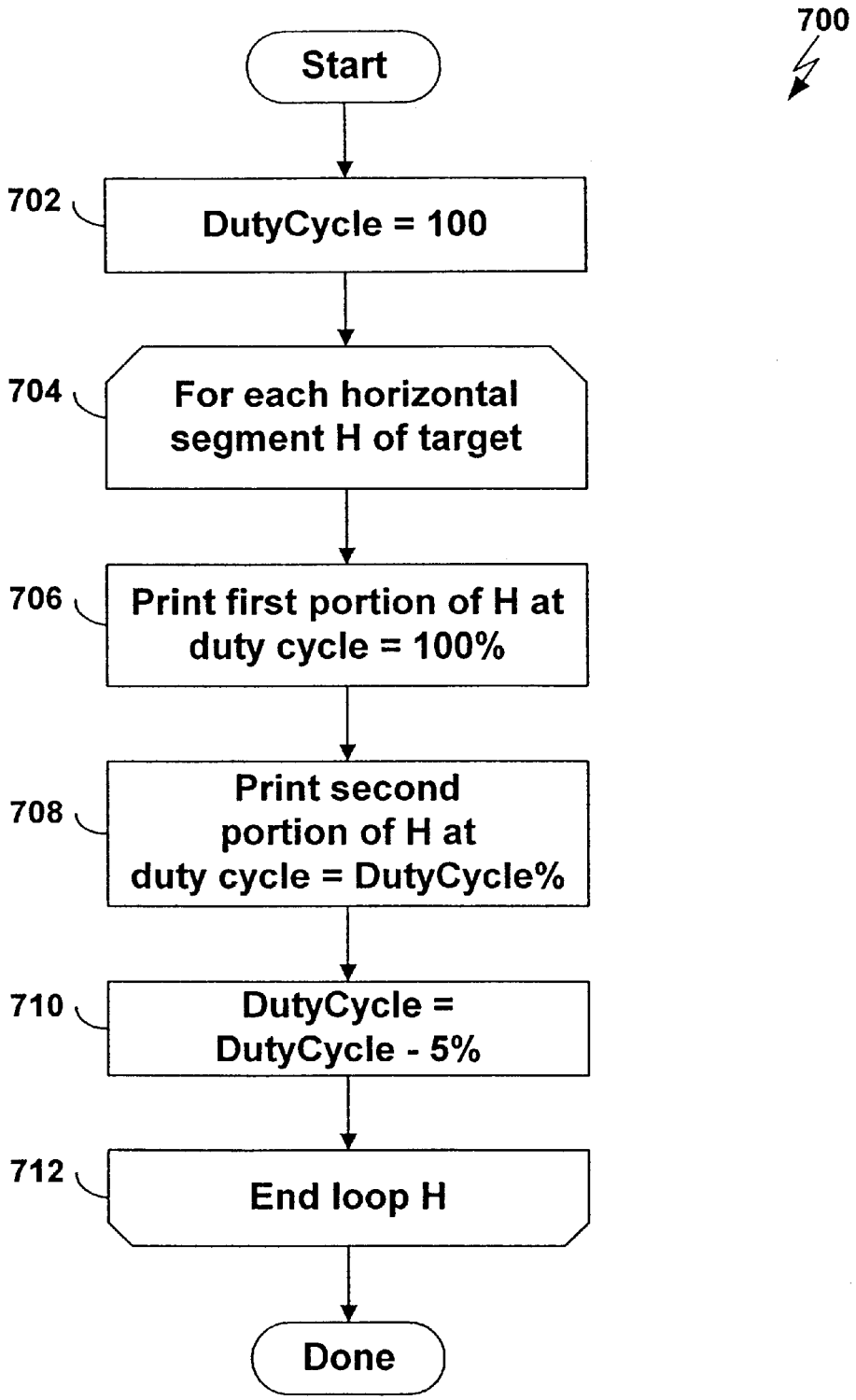
FIGS. 7A–7B are flow charts of methods that are used to render the target of FIG. 6B based on the digital target of FIG. 6A in particular embodiments of the present invention.

As described above, the target source 600 is a digital image. In one embodiment of the present invention, the source target 600 is rendered on an output medium as an output target by a thermal printer using a process 700 shown in FIG. 7A. For purposes of example, FIG. 6A is oriented with its vertical axis being parallel to a slow scan direction of the thermal printer. As a result, horizontally-adjacent pixels in the source target 600 are rendered by different print head elements. The process 700 begins by setting the value of a variable named DutyCycle to 100 (step 702).

As shown in FIG. 6A, the target 600 includes a series of horizontal segments 610*a–f*. The horizontal segments 610*a–f* contain first portions 606*a–f* and second portions 608*a–f*. For example, horizontal segment 610*a* includes: (1) a first portion 606*a* including two horizontal bars 604*a–b* and a portion 602*a* of the vertical bar 602 located between the two horizontal bars 604*a–b*, and (2) a second portion 608*a* including a portion 602*b* of the vertical bar 602 that is not between the two horizontal bars 604*a–b*. The remaining horizontal segments 610*b–f* contain similar first and second portions (which are not separately labeled in FIG. 6A for ease of illustration).

The process 700 enters a loop over each horizontal segment H in the source target 600. The first portion of the horizontal segment H is printed with a predetermined duty cycle, such as 100% (step 706). As used herein, the term "duty cycle" refers to the amount of time that a heating element is activated in order to print a spot relative to the time of a single print head cycle. This can be expressed as:

$$\text{duty cycle} = \frac{t_n}{T_c}.$$

A duty cycle may, for example, be expressed as a percentage of a print head cycle. For example, a duty cycle of 100% refers to the entire duration of a print head cycle. Therefore, in step 706, active print head elements are activated for 100% of each print head cycle when printing the first portion of horizontal segment H.

Figure 6B:
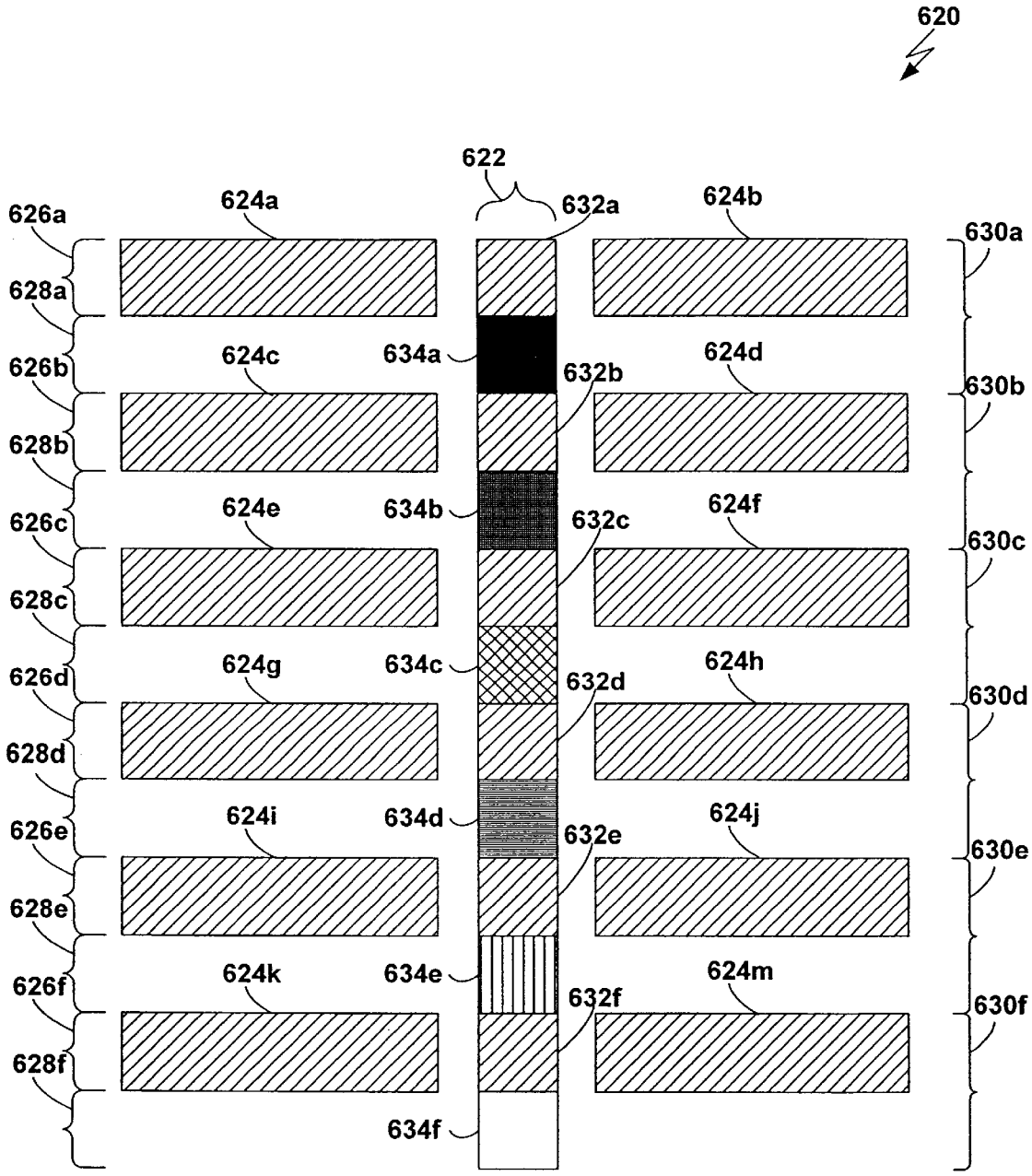
FIG. 6B is a diagram of the target of FIG. 6A as rendered on an output medium.

The second portion of the horizontal segment H (i.e., the portion not containing horizontal bars) is printed with a duty cycle equal to DutyCycle (step 708). The value of DutyCycle is decreased by 5%, or some other predetermined value (step 710). As a result, the second portions 608*a–f* of the source target 600 are printed using decreasing duty cycles going down the target 600. Steps 706–710 are repeated for the remaining horizontal segments in the source target 600 (step 712). Referring to FIG. 6B, an output target 620 is shown as it might appear on an output medium when rendered by a thermal printer using the process 700.

Returning for a moment to FIG. 6A, it can be seen that there are many more gray pixels in each row of the first horizontal portions 606*a–f* than in each row of the second horizontal portions 608*a–f*. As a result, more print head elements will be contemporaneously active when the first portions 606*a–f* are being printed than when the second portions 608*a–f* are being printed. Therefore, based on the discussion above, it is to be expected that each of the first portions 606*a–f* will, when printed, have a lower pigment density, and therefore appear lighter, than a corresponding one of the second portions 608*a–f* that is printed using the same duty cycle.

The vertical bar 602 (FIG. 6A), when rendered on the output medium, will appear to be a vertical bar 622 (FIG. 6B) consisting of alternating first squares 632*a–f* and second squares 634*a–f*. The second squares 634*a–f* appear successively lighter moving from the top to the bottom of the output target 620. For example, second square 634*c* is lighter than second square 634*b*, which in turn is lighter than second square 634*a*. Increasingly light shades are represented by various cross-hatch patterns in FIG. 6B. The increasing lightness of second squares 634*a–f* is the result of using decreasing duty cycles to print each successive second portion in the process 700.

Now turn to first portions 626*a–f* of horizontal segments 630*a–f* (FIG. 6B), which are the result of rendering first portions 606*a–f* of horizontal segments 610*a–f* (FIG. 6A). Although first portions 606*a–f* (FIG. 6A) were rendered using a 100% duty cycle, corresponding first portions 626*a–f* (FIG. 6B) appear lighter than otherwise would have occurred where there was no common voltage effect. The energy output of the print head elements was correspondingly decreased according to Equation 11, resulting in less dense (i.e., lighter) output.

It should be appreciated that the roles of the first portions 606*a–f* of horizontal segments 610*a–f* (FIG. 6A) can be exchanged with second portions 608*a–f*. More specifically, all second portions may be printed with a fixed duty cycle that is less than 100% (e.g. 80%), while first portions 606*a–f* may be printed with duty cycles that step through predetermined cycles, starting at duty cycle value of the second portions 608*a–f* and increasing toward 100%.

To find the value of r, one may visually inspect the center bar 602, finding which of squares 634*a–f* (of varying shades) match squares 632*a–f* (of constant shade) using a process described below. A sufficiently good match is found when one cannot perceive a difference in shade between adjacent squares. If no match is found, one may estimate a new starting value for DutyCycle in process 700 and a refined step size for changing it in step 710.

Finding a visual match between adjacent squares indicates that the adjacent squares were printed with the same energy per pulse. Using Equation 7 and Equation 8, we can write this equality as:

$$\frac{V_0^2}{R(1+nr)^2} f t_0 = \frac{V_0^2}{R(1+Nr)^2} t_0. \qquad \text{Equation 20}$$

Here, n is the number of contemporaneously active elements in second squares 634*a–f*, N is the number of contemporaneously active elements in first squares 632*a–f*, and f is the percent duty cycle for the matching square expressed as a fraction. Solving Equation 20 for r yields:

$$r = \frac{(1-\sqrt{f})}{(\sqrt{f}\,N - n)}. \qquad \text{Equation 21}$$

It should be appreciated that if the roles of the squares 632*a–f* and 634*a–f* are exchanged as described above, then Equation 21 will need to be changed in a manner that will be apparent to those of ordinary skill in the art.

Figure 7B:
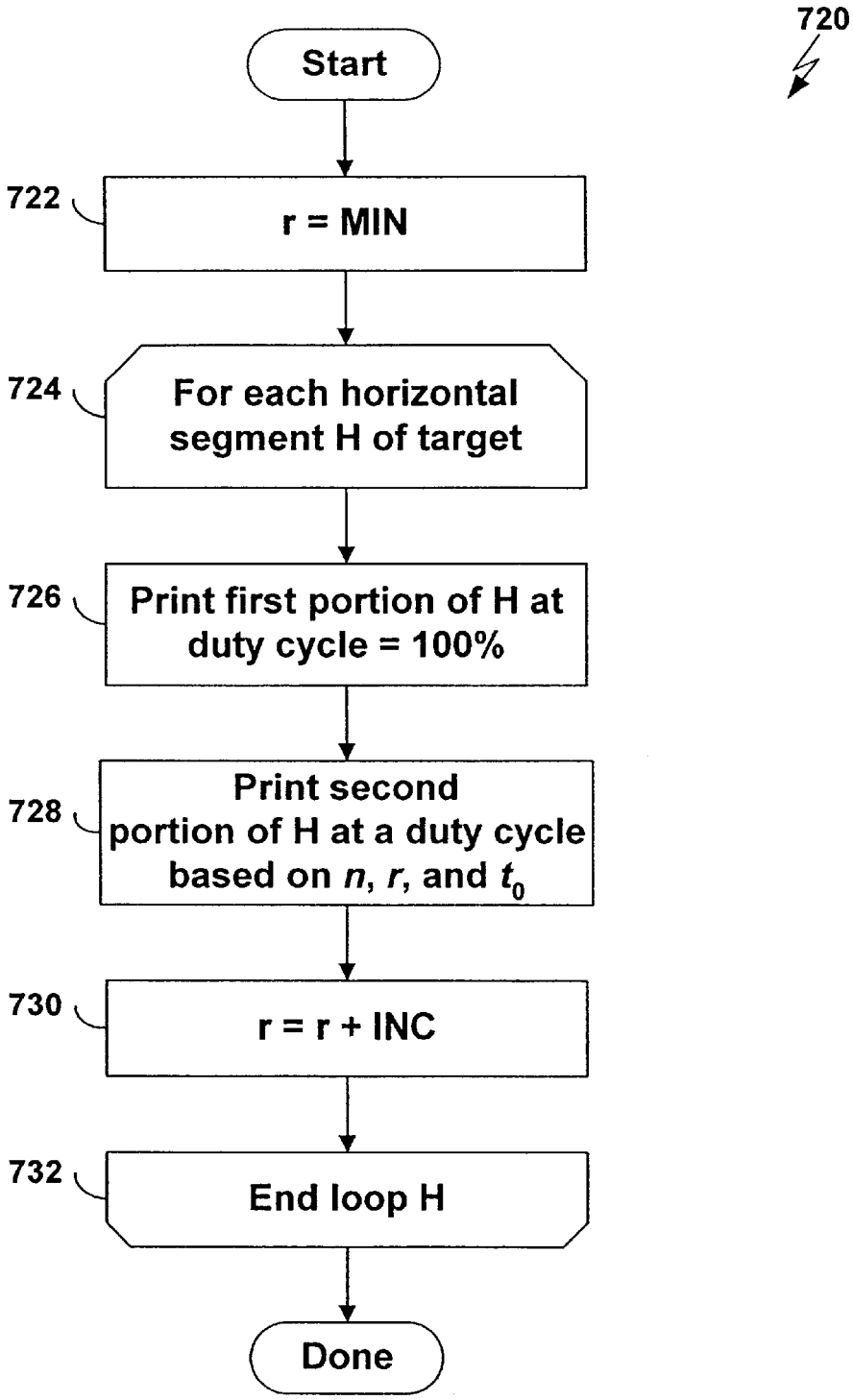

Another technique for rendering the source target 600 will now be described. In another embodiment of the present invention, the source target 600 is rendered on an output medium as an output target by a thermal printer using a process 720 shown in FIG. 7B. The process 720 is similar to the process 700, except that it varies the duty cycle used to print the horizontal segments 630*a–f* by varying the value of r, rather than by directly varying the duty cycle.

More specifically, the process 720 begins by setting the value of r to a maximum value MAX (step 722). The value MAX may be chosen in any manner, but should be selected to be greater than the maximum value expected for r based on any pre-existing knowledge of the circuitry 200. Using this maximum value of r plus knowledge of the number of print head elements, N, the time for a print head cycle, $T_c$, and Equations 17 and 18, a value for $t_0$ is computed for use in the process. The process 720 enters a loop over each horizontal segment H in the source target 600. Both portions of the horizontal segment H are printed with duty cycles that are based on the known values of n and $t_0$ and the current value of r (steps 726 and 728). The duration $t_n$ of the duty cycle may, for example, be calculated using Equation 11, as described above. The value of r is decreased by a predetermined value INC, which may be selected in any manner (step 730). The value INC may be selected, for example, so that the values of r used to print the horizontal segments 630*a–f* span a range of values for r that is likely to include an optimal value for r. Steps 726–730 are repeated for the remaining horizontal segments in the source target 600 (step 732). The output target generated by the process 720 will be substantially similar to the output target 620 shown in FIG. 6B, although the specific darknesses (gray levels) of both the first and second portions of 630*a–f* rendered by processes 700 and 720 may not be the same.

Referring to FIG. 8, in one embodiment of the present invention, characteristics of the output target 620 may be used to estimate the ratio r (used by Equation 11) using a process 800. The output target 620 is rendered, such as by the process 700 (FIG. 7A) or by the process 720 (FIG. 7B) described above (step 802). A second square in the output target 620 is identified whose tone (e.g., blackness) most closely matches the tone of the first squares 632*a–f* (step 804). This identification may be performed, for example, by visually inspecting the output target 620 and identifying the second square whose tone appears to match the tone of the first squares 632*a–f* most closely.

The arrangement of the first squares 632*a–f* and the second squares 634*a–f* in the output target 620 may be used to facilitate this identification by visual inspection. Note, for example, that at the top of output target 620, first square 632*a* is lighter than corresponding second square 634*a*, which is very dark. Turning to the bottom of output target 620, the situation is reversed: first square 632*f* is darker than second square 634*f*. Since second squares 634*a–f* are successively lighter moving from the top to the bottom of output target 620, there should be a second square having a blackness that matches the blackness of the first squares more closely than any other second square. The arrangement of first squares 632*a–f* and second squares 634*a–f* facilitates the visual identification of this second square. The viewer may, for example, begin by inspecting and comparing the darkness of the second square 634*a* at the top of the output target 620 to the blacknesses of the first squares 632*a* and 632*b* immediately above and below it. The viewer may continue by moving down the output target 620 and comparing the blackness of each of the second squares 634*a–f* to that of the first squares above and below it, until a second square having a blackness that most closely matches the blackness of the first squares 632*a–f* is identified. The uniform blackness of the first squares 632*a–f* (which serves as a reference point against which the blacknesses of the second squares 634*a–f* may be compared), the decreasing blackness of the second squares 634*a–f*, and the physical proximity of the second squares 634*a–f* to the first squares 632*a–f* facilitates the process of selecting a second square whose blackness most closely matches that of the first squares 632*a–f*.

Once a second square has been identified (such as by using the techniques just described), a value of r is selected based on the identified second square (step 806). For example, if the output target 620 was rendered by the process 720 (FIG. 7B), then the value of r that was used to print the identified second square is a known value (see step 728). Therefore, step 806 may be performed by identifying the value of r that was used in step 728 of process 720 to print the second square. Assume, for example, that second squares 634*a–f* are numbered sequentially beginning with zero (e.g., second square 634*a* is square zero, second square 634*b* is square one, etc.). Then, if square number m is identified in step 804, the corresponding value of r selected in step 806 is equal to MAX–(m×INC) (where MAX and INC are the values used by process 720).

FIGS. 6A and 6B show specific examples of a source target 600 and an output target 620, respectively. It should be appreciated, however, that these targets 600 and 620 are shown and described merely for purposes of example and do not constitute limitations of the present invention. Rather a variety of other targets that may be used to select a value of r are within the scope of the claims.

More generally, source and output targets that may be used in various embodiments of the present invention have the following features. In general, a source target (e.g., source target 600) is a digital image that may be rendered on an output medium as an output target (e.g., output target 620). The source target includes a first plurality of source regions (e.g., the first portions 606*a–f*) having a predetermined digital value. Pixels in the first plurality of source regions are arranged so that a first predetermined number of heating elements are active when the first plurality of source regions are rendered on the output medium as a first plurality of output regions (e.g., the first portions 626*a–f*). The first plurality of source regions are rendered on the output medium using a constant duty cycle (e.g., as described with respect to steps 706 and 726 above). Because pixels in the first plurality of source regions have the same predetermined digital value, are rendered using the same number of active heating elements, and are rendered using the same duty cycle, the plurality of output regions will have a constant blackness that may serve as a visual reference point.

The source target also includes a second plurality of source regions (e.g., second portions 608*a–f*) also having the predetermined digital value. Pixels in the second plurality of source regions are arranged so that a second predetermined number of heating elements are active when the second plurality of source regions are rendered on the output medium as a second plurality of output regions. The second plurality of source regions are rendered on the output medium using a plurality of duty cycles (e.g., as described above with respect to steps 708 and 728). Because the second plurality of source regions have the same predetermined digital value and are rendered using the same number of active heating elements, but are rendered using a plurality of duty cycles, the second plurality of output regions will have different blacknesses.

The first and second predetermined numbers of heating elements are chosen to be unequal. For example, in one embodiment of the present invention, the first predetermined number of heating elements (i.e., the number of heating elements that are active when rendering the first plurality of source regions) is chosen to be substantially larger than the second predetermined number of heating elements (i.e., the number of heating elements that are active when rendering the second plurality of source regions).

In addition, the predetermined number of heating elements in regions 604*a–m* do not necessarily need to be the same. Using different numbers of heating elements would, for instance, facilitate using processes 700 or 720 with a lookup table approach.

The output target may be visually inspected to identify one of the second plurality of output regions whose blackness most closely matches the blackness of the first plurality of output regions (e.g., as described above with respect to step 804). The second plurality of output regions may be located near the first plurality of output regions to facilitate such identification. The ratio r may be determined based on the selected one of the second plurality of output regions, as described in more detail above with respect to the particular embodiments described.

Although in the examples described above the first portions 606*a–f* are rendered using a constant duty cycle and the second portions 608*a–f* are rendered using a varying duty cycle, the situation may be reversed. In other words, the first portions 606*a–f* may be rendered using a varying duty cycle and the second portions may be rendered using a constant duty cycle.

Furthermore, although the examples above are described with respect to a grayscale source and output target, this is not a limitation of the present invention. Rather the source and output targets may be color images, in which case the term "tone" may be substituted for "blackness" in the description of the source and output targets above.

It should be appreciated that the various features of embodiments of the present invention described above and described in more detail below provide numerous advantages.

By making constant the amount of energy delivered by each active print head element to the output medium during each print head cycle, various embodiments of the present invention may be used to render output having tones (e.g., gray levels) that more accurately represent the tones in the source image being rendered. Because the energy output by an active print head element in a particular print head cycle is independent of the number of print head elements that are active during the print head cycle, various embodiments of the present invention avoid undesirable variations in output based on the number of contemporaneously active print head elements.

Various embodiments of the source and output targets described above may be advantageously used to select the ratio r by a simple process of visual inspection. As described above, the output target may be visually inspected and a value of r may be obtained based on the inspector's visual identification of two regions in the target whose tone matches most closely. This technique may be applied quickly and without the need to perform mechanical or electrical tests on the hardware of the thermal printer, further simplifying the process while still obtaining accurate results.

As described above, some existing systems attempt to compensate for decreased energy output when many print head elements are active by increasing the gray level of pixels being printed when many print head elements are contemporaneously active. The gray level of a pixel is typically increased by printing more spots for each pixel, i.e., by activating the corresponding print head for a greater number of print head cycles. This technique may, however, interfere or be inconsistent with other techniques used by thermal printers. For example, there is a limit to the number of print head elements that may be active during a particular print head cycle in some thermal printers. As a result, a technique referred to as "pixel alternation" is sometimes used by thermal printers to print digital images. Using this technique, disjoint subsets of the print head elements are allowed to be active during each successive print head cycle in a round-robin fashion. Each subset contains no greater than the maximum number of allowed print head elements, thereby satisfying the above-stated requirement.

The technique above, in which the gray levels of pixels are increased by printing additional spots for each pixel, may interfere with pixel alternation techniques by requiring that a print head element be active during a particular print head cycle even though that print head element is not in the designated subset of print head elements for that print head cycle.

In contrast, various embodiments of the present invention may be used in conjunction with any combination of active print head elements during a particular print head cycle or across print head cycles. Such embodiments may, therefore, work in conjunction with pixel alternation techniques, in combination with any variety of halftone patterns, and more generally in combination with any pattern of pixels. Such embodiments may therefore be advantageously used to improve print output quality without interfering with a wide variety of other techniques conventionally used in thermal printers.

The present invention has been described above in terms of various embodiments. Various other embodiments, including but not limited to the following, are also within the scope of the claims.

Although the print head element resistors 208*a–d* are shown and described above as having the same resistance R, it should be appreciated that this does not constitute a limitation of the present invention. Rather, the print head element resistors 208*a–d* may have different resistances, in which case the calculations described above may be modified appropriately as will be apparent to those of ordinary skill in the art.

Although some embodiments may be described herein with respect to bilevel thermal printers, it should be appreciated that this is not a limitation of the present invention. Rather, the techniques described above may be applied to printers other than thermal printers, and to printers other than bilevels printers.

Although various embodiments are described herein with respect to the print head circuitry 200, this is purely for purposes of example and does not constitute a limitation of the present invention. Rather, the techniques described herein may be applied to devices other than thermal printers that include circuitry whose structure is similar to the circuitry 200 shown in FIG. 2.

Various examples described above refer to print head elements that are contemporaneously active during a particular print head cycle. It should be appreciated, however, that the techniques described herein may be used to apply a desired amount of power to a particular number of print head elements or other circuit components during any time interval. Although a single print head cycle is used as an example of such a time interval in various parts of the description herein, this is not a limitation of the present invention. Rather, the time interval may be longer or shorter than a print head cycle.

In general, the techniques described above may be implemented, for example, in hardware, software, firmware, or any combination thereof. The techniques described above may be implemented in one or more computer programs executing on a programmable computer and/or printer including a processor, a storage medium readable by the processor (including, for example, volatile and non-volatile memory and/or storage elements), at least one input device, and at least one output device. Program code may be applied to data entered using the input device to perform the functions described herein and to generate output information. The output information may be applied to one or more output devices.

Printers suitable for use with various embodiments of the present invention typically include a print engine and a printer controller. The printer controller receives print data from a host computer and generates page information, such as a logical halftone to be printed based on the print data. The printer controller transmits the page information to the print engine to be printed. The print engine performs the physical printing of the image specified by the page information on the output medium.

Elements and components described herein may be further divided into additional components or joined together to form fewer components for performing the same functions.

Each computer program within the scope of the claims below may be implemented in any programming language, such as assembly language, machine language, a high-level procedural programming language, or an object-oriented programming language. The programming language may be a compiled or interpreted programming language.

Each computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output.

It is to be understood that although the invention has been described above in terms of particular embodiments, the foregoing embodiments are provided as illustrative only, and do not limit or define the scope of the invention. Other embodiments are also within the scope of the present invention, which is defined by the scope of the claims below. Other embodiments that fall within the scope of the following claims include, but are not limited to, the following.

What is claimed is:

1. In a thermal printer comprising a plurality of print head elements, a method for printing at least a first line of a digital image comprising steps of:

(A) delivering a predetermined amount of energy to each print head element in a first subset of $n_1$ of the plurality of print head elements during a first period of time to print a first part of said first line of said digital image;

(B) delivering the predetermined amount of energy to a second subset of $n_2$ of the print head elements during a second period of time, $n_1$ not being equal to $n_2$, to print a second part of said first line of said digital image;

wherein step (B) commences immediately after delivery of the amount of energy delivered in step (A) is terminated.

2. The method of claim 1, wherein step (A) comprises a step of:

(A)( 1) delivering a first predetermined amount of power to each print head element in the first subset of print head elements for a first amount of time, wherein the predetermined amount of energy is equal to the first predetermined amount of power multiplied by the first amount of time; and wherein the step (B) comprises a step of:

(B)( 1) delivering a second predetermined amount of power to each print head element in the second subset of print head elements for a second amount of time, wherein the predetermined amount of energy is equal to the second predetermined amount of power multiplied by the second amount of time.

3. In a thermal printer comprising a plurality of print head elements, a method for providing a predetermined amount of energy to each print head element in a subset of n of the plurality of print head elements, the method comprising steps of:

(A) selecting an amount of time $t_n$ to provide a predetermined amount of power $P_n$ to each print head element in the subset of the plurality of print head elements, $t_n$ being a function of n, by (1) selecting a correction factor that is a function of n, and (2) calculating the value of $t_n$ by multiplying the correction factor by a predetermined amount of time $t_o$; and (B) providing the amount of power $P_n$ to each print head element in the subset of the plurality of print head elements for amount of time $t_n$.

4. The method of claim 3, wherein the amount of time $t_n$ is less than the duration of a print head cycle of the thermal printer.

5. The method of claim 3, wherein the plurality of print head elements are wired in parallel with each other, wherein each of the plurality of print head elements includes a print head element resistor having a resistance R, wherein the plurality of print head elements is wired in series with a common resistor having a resistance $R_i$, and wherein the step (A)(1) comprises a step of selecting a correction factor that is equal to:

$$\left(1+\frac{nR_i}{R}\right)^2$$

6. The method of claim 3, wherein the plurality of print head elements are wired in parallel with each other, wherein each of the plurality of print head elements includes a print head element resistor having a resistance R, wherein the plurality of print head elements is wired in series with a common resistor having a resistance $R_i$, and wherein the step (A)(1) comprises a step of selecting a correction factor that is equal to:

$$1+\frac{2nR_i}{R}$$

7. The method of claim 3, wherein the step (A) comprises a step of looking up a predetermined value of $t_n$ in a lookup table that is indexed by n.

8. The method of claim 3, wherein the value of n may vary from print head cycle to print head cycle of the thermal printer, and wherein the method further comprises a step of:

(A) performing the steps (A) and (B) for each of a plurality of print head cycles used by the thermal printer to render at least a portion of an image on an output medium.

9. A method for rendering a source target on an output medium as an output target for use in selecting a correction factor to correct energy output by electronic circuitry, the method comprising steps of:

(A) rendering a first plurality of source regions in the source target using a first duty cycle to produce a first plurality of output regions in the output target, the first plurality of source regions including pixels having a predetermined digital value; and (B) rendering a second plurality of source regions in the source target using a predetermined set of at least three different duty cycles to produce a second plurality of output regions in the output target, the second plurality of source regions including pixels having the predetermined digital value, wherein said predetermined set of at least three duty cycles is selected independently of the number of print head elements which are active in the rendering of said second plurality of source regions.

10. The method of claim 9, wherein the step (A) comprises a step of rendering rows of pixels in the first plurality of source regions using a first predetermined number of print head elements, wherein the step (B) comprises a step of rendering rows of pixels in the second plurality of source regions using a second predetermined number of print head elements, and wherein the first predetermined number of print head elements and the second predetermined number of print head elements are not equal.

11. The method of claim 9, wherein the step (B) comprises steps of:

(B)(1) selecting a duty cycle;

(B)(2) selecting one of the plurality of source regions;

(B)(3) rendering the selected one of the plurality of source regions using the selected duty cycle;

(B)(4) modifying the selected duty cycle; and (B)(5) repeating the steps (B)(2) through (B)(4) for each of the plurality of source regions.

12. The method of claim 11, wherein the step (B)(4) comprises a step of adding a predetermined value to the duty cycle.

13. The method of claim 11, wherein the step (B)(1) comprises a step of selecting the duty cycle based on a correction factor, and wherein the step (B)(4) comprises steps of modifying the correction factor and modifying the duty cycle based on the modified correction factor.

14. The output target rendered by the method of claim 9.

15. The method of claim 9, further comprising (C) identifying one of said second plurality of output regions in said output target having substantially the same density as that of the first plurality of output regions in said output target;

(D) identifying the duty cycles used to render said one of said second plurality of output regions identified in step (C); and (E) selecting a correction factor based on the duty cycles identified in step (D).

* * * * *